US011357093B2

(12) United States Patent
Asad et al.

(10) Patent No.: US 11,357,093 B2
(45) Date of Patent: Jun. 7, 2022

(54) NOZZLE ASSEMBLY, DEVICE FOR GENERATING AN ATMOSPHERIC PLASMA JET, USE THEREOF, METHOD FOR PLASMA TREATMENT OF A MATERIAL, IN PARTICULAR OF A FABRIC OR FILM, PLASMA TREATED NONWOVEN FABRIC AND USE THEREOF

(71) Applicant: PlasmaTreat GmbH, Steinhagen (DE)

(72) Inventors: Syed Salman Asad, Bielefeld (DE); Andreas Liebert, Bielefeld (DE); Christian Buske, Bielefeld (DE)

(73) Assignee: PlasmaTreat GmbH, Steinhagen (DE)

( * ) Notice: Subject to any disclaimer, the term of this patent is extended or adjusted under 35 U.S.C. 154(b) by 0 days.

(21) Appl. No.: 16/468,218

(22) PCT Filed: Dec. 21, 2017

(86) PCT No.: PCT/EP2017/084189
§ 371 (c)(1),
(2) Date: Jun. 10, 2019

(87) PCT Pub. No.: WO2018/115335
PCT Pub. Date: Jun. 28, 2018

(65) Prior Publication Data

US 2019/0394867 A1 Dec. 26, 2019

(30) Foreign Application Priority Data

Dec. 23, 2016 (DE) ..... 10 2016 125 699.4
Aug. 15, 2017 (DE) ..... 10 2017 118 572.0

(51) Int. Cl.
*H05H 1/48* (2006.01)
*H05H 1/34* (2006.01)

(52) U.S. Cl.
CPC ..... *H05H 1/48* (2013.01); *H05H 1/34* (2013.01); *H05H 1/3478* (2021.05);
(Continued)

(58) Field of Classification Search
CPC ..... H05H 1/48; H05H 1/34; H05H 2240/10; H05H 2240/20; H05H 2001/3478;
(Continued)

(56) References Cited

U.S. PATENT DOCUMENTS 5,102,523 A * 4/1992 Beisswenger ..... H01J 37/32009 118/723 E
5,518,572 A * 5/1996 Kinoshita ..... G21K 1/14 118/723 E
(Continued)

FOREIGN PATENT DOCUMENTS

CN 101831798 A 9/2010
CN 104025719 A 9/2014
(Continued)

*Primary Examiner* — Eric S Stapleton
(74) *Attorney, Agent, or Firm* — The Webb Law Firm

(57) ABSTRACT

A nozzle assembly for generating an atmospheric plasma jet includes an inlet, through which the jet can be introduced into the nozzle assembly, and a channel connected to the inlet so that the plasma jet introduced is conducted through the channel. Multiple nozzle openings are provided in the channel wall along the channel, through which a plasma jet can exit the assembly. The cross section of the channel in the region of a nozzle opening is shaped in such a way that a virtual medial plane runs between a virtual first tangent plane of the cross section through the nozzle opening and a virtual second tangent plane of the cross section opposite thereto and parallel to the first tangent plane divides the cross section into a first cross-sectional area at the nozzle
(Continued)

opening. The cross-sectional surface of the first cross-sectional area differs from the cross-sectional surface of the second.

9 Claims, 14 Drawing Sheets

(52) U.S. Cl.
CPC ..... *H05H 2240/10* (2013.01); *H05H 2240/20* (2013.01); *H05H 2245/40* (2021.05)

(58) Field of Classification Search
CPC ..... H05H 2245/123; H05H 1/46; H05H 2001/466; H01J 37/32192; H01J 37/32366
USPC ..... 219/121.5; 156/345.39, 345.43; 118/723 ER, 723 IR; 315/111.21
See application file for complete search history.

(56) References Cited

U.S. PATENT DOCUMENTS 5,837,958 A * 11/1998 Fornsel ..... B08B 7/0035 219/121.5
5,865,896 A * 2/1999 Nowak ..... H01J 37/32091 118/723 AN
6,030,667 A * 2/2000 Nakagawa ..... H01J 37/321 427/569
6,098,568 A * 8/2000 Raoux ..... C23C 16/5096 118/723 E
6,162,323 A * 12/2000 Koshimizu ..... H01J 37/3244 156/345.26
6,217,703 B1 * 4/2001 Kitagawa ..... H01J 37/32357 118/715
6,355,312 B1 * 3/2002 Fornsel ..... C03C 25/6293 427/488
6,408,755 B1 * 6/2002 Meisters ..... B41N 3/006 101/463.1
6,419,995 B1 * 7/2002 Kuckertz ..... B05D 3/142 427/536
6,613,394 B2 * 9/2003 Kuckertz ..... B05D 3/142 427/488
6,659,110 B2 * 12/2003 Fornsel ..... B08B 7/0035 134/1.1
6,663,715 B1 * 12/2003 Yuda ..... C23C 16/45519 118/723 ER
6,677,550 B2 * 1/2004 Fornsel ..... H05H 1/34 219/121.5
6,800,336 B1 * 10/2004 Fornsel ..... C23C 8/36 118/723 E
7,034,285 B2 * 4/2006 Ichiki ..... H01J 37/08 250/251
7,875,356 B2 * 1/2011 Hilmer ..... B32B 27/40 428/425.5
7,981,219 B2 * 7/2011 Straccia ..... B05D 3/144 118/729
8,007,916 B2 * 8/2011 Kuhmann ..... B32B 27/08 428/474.9
8,124,953 B2 * 2/2012 Elian ..... H01L 21/563 257/3
8,267,884 B1 * 9/2012 Hicks ..... A61B 18/042 604/23
8,859,056 B2 * 10/2014 O'Neill ..... C23C 4/02 427/569
8,963,044 B2 * 2/2015 Kim ..... H05H 1/2406 219/121.5
9,532,440 B2 * 12/2016 Stehrer ..... B23K 10/00
10,420,852 B2 * 9/2019 Pouvesle ..... H05H 1/46
2003/0051665 A1 * 3/2003 Zhao ..... C23C 16/5096 118/723 E
2004/0045319 A1 * 3/2004 Schussler ..... C03B 23/043 65/34
2004/0206305 A1 * 10/2004 Choi ..... C23C 16/45565 118/715
2005/0028935 A1 * 2/2005 Wickramanayaka ..... H01J 37/3244 156/345.34
2005/0118350 A1 * 6/2005 Koulik ..... A61B 18/042 427/535
2005/0284568 A1 * 12/2005 America ..... H01L 21/6708 156/345.5
2007/0029500 A1 * 2/2007 Coulombe ..... H05H 1/48 250/423 F
2007/0193515 A1 * 8/2007 Jeon ..... H01J 37/3211 118/723 IR
2007/0235417 A1 * 10/2007 Kuo ..... H05H 1/34 219/121.5
2008/0187765 A1 * 8/2008 Hilmer ..... C03C 25/6293 428/425.6
2008/0193775 A1 * 8/2008 Hilmer ..... C08L 83/00 428/425.5
2009/0065485 A1 * 3/2009 O'Neill ..... H05H 1/46 219/121.52
2009/0156013 A1 * 6/2009 Yousif ..... H01J 37/32357 438/725
2010/0021340 A1 * 1/2010 Buske ..... H05H 1/48 422/28
2011/0111236 A1 * 5/2011 Pahl ..... C09J 163/00 428/457
2012/0067716 A1 * 3/2012 Buske ..... G01N 27/70 204/164
2012/0261391 A1 * 10/2012 Ihde ..... B22F 1/02 219/121.52
2013/0001204 A1 * 1/2013 Mistry ..... D06M 10/025 219/121.59
2013/0108804 A1 * 5/2013 Massines ..... H05H 1/42 427/569
2013/0144244 A1 * 6/2013 Roe ..... A61F 13/5146 604/385.24
2013/0199540 A1 * 8/2013 Buske ..... A61B 18/042 128/845
2014/0023856 A1 * 1/2014 Bisges ..... C23C 16/06 428/329
2014/0042130 A1 * 2/2014 Descamps ..... H05H 1/48 219/121.5
2014/0170410 A1 * 6/2014 Rupprecht ..... C23C 4/00 428/327
2014/0248444 A1 * 9/2014 Massines ..... H05H 1/2406 427/569
2015/0105716 A1 * 4/2015 Ish-Yamini Tomer ..... B01J 19/088 604/23

FOREIGN PATENT DOCUMENTS

CN 104321540 A 1/2015
CN 205961555 U 2/2017
CN 106488639 A 3/2017
DE 19532412 C2 9/1999
DE 20308202 U1 11/2003
DE 102012107282 A1 7/2013
JP 2011154973 A 8/2011
JP 2017535935 A 11/2017
WO 0079843 A1 12/2000
WO 2005117507 A2 12/2005
WO 2007094572 A1 8/2007
WO 2016083539 A1 6/2016

* cited by examiner

NOZZLE ASSEMBLY, DEVICE FOR GENERATING AN ATMOSPHERIC PLASMA JET, USE THEREOF, METHOD FOR PLASMA TREATMENT OF A MATERIAL, IN PARTICULAR OF A FABRIC OR FILM, PLASMA TREATED NONWOVEN FABRIC AND USE THEREOF

CROSS-REFERENCE TO RELATED APPLICATIONS

This application is the United States national phase of International Application No. PCT/EP2017/084189 filed Dec. 21, 2017, and claims priority to German Patent Application Nos. 10 2016 125 699.4 filed Dec. 23, 2016, and 10 2017 118 572.0 filed Aug. 15, 2017, the disclosures of which are hereby incorporated by reference in their entirety.

BACKGROUND OF THE INVENTION

The invention relates to a nozzle assembly for an device for generating an atmospheric plasma jet comprising an inlet through which an atmospheric plasma jet can be introduced into the nozzle assembly, and comprising a channel which is connected to the inlet such that a plasma jet which has been introduced into the nozzle assembly through the inlet is conducted through the channel. The invention also relates to a device for generating an atmospheric plasma jet.

The invention further relates to a method for plasma treatment of a fabric or a plastic film and a plasma-treated nonwoven fabric.

In the manufacture of diapers, sanitary napkins or pads (e.g. bed pads) layers of nonwoven fabric, in particular so-called absorption layers and distribution layers are used with which liquid can be conducted quickly from the skin surface into an absorber material, typically in a layer with so-called superabsorbers (superabsorbent polymers). The distribution layers are often referred to in practice as AQL (Acquisition Layer) or ADL (Acquisition Distribution Layer).

These nonwoven layers, especially ADLs/AQLs, come in different grades. The quality of the nonwoven layer results from the liquid strike-through time, determined according to ISO 9073-13:2006, which represents a measure of the speed with which liquid is taken up by the nonwoven layer and passed on. The lower the strike-through time, the better is the function of the nonwoven layer in the diaper, sanitary napkin or pad.

Because the nonwoven layers, particularly the ADLs/AQLs, account for a significant proportion of the material costs of the diaper, napkin, or pad, low cost, low quality nonwoven layers with high strike-through time are often used, thereby impairing the function of the diaper, sanitary napkin, or pad. For higher quality products, higher quality nonwoven layers are used. These, however, are on the one hand more expensive and on the other hand have a higher surface weight, which also results in a higher material consumption and a higher weight of the diaper, sanitary napkin or pad.

There is a need to improve the strike-through times of thin or low-cost nonwoven layers or ADLs/AQLs, in order to be able to produce diapers, sanitary napkins or pads of good quality at a lower cost.

SUMMARY OF THE INVENTION

The present invention is therefore based on the object of providing a device and a method with which in particular the strike-through time of nonwoven layers, in particular of ADLs/AQLs, can be improved.

According to a first teaching, in the case of a nozzle assembly for a device for generating an atmospheric plasma jet comprising an inlet through which an atmospheric plasma jet can be introduced into the nozzle assembly, and comprising a channel which is connected to the inlet such that a plasma jet introduced into the nozzle assembly through the inlet is conducted through the channel, this object is achieved according to the invention in that multiple nozzle openings are provided in the channel wall along the channel, through which a plasma jet which is conducted through the channel can exit the nozzle assembly.

Furthermore, in the case of a device for generating an atmospheric plasma jet comprising a discharge space, wherein the device is configured to generate an atmospheric plasma jet in the discharge space, the object is achieved according to the invention in that a nozzle assembly of the type described above is connected to the discharge space in such a way that a plasma jet generated in the discharge space is introduced into the inlet of the nozzle assembly.

It has been recognised that the strike-through time of nonwoven fabrics can be improved by treating the nonwoven fabric with an atmospheric plasma jet. It has been found, however, that plasma jets according to the prior art for generating an atmospheric plasma jet are poorly suited for this purpose, since the thin nonwoven fabrics used for diapers, sanitary napkins and pads are very temperature sensitive and rapidly damaged by exposure to an atmospheric plasma jet, and especially may tear or melt. Even a corona treatment or a treatment with dielectrically impeded discharge is not a sensible alternative since this leads to holes in the nonwoven fabrics due to the associated streamers and discharge filaments, has only a superficial effect in contrast to a plasma jet, and results in only a small reduction of the strike-through time. Although a gentler treatment would be possible with low-pressure plasma, such systems are expensive and difficult to integrate into production lines, especially with the typically required production throughput.

In contrast, with the nozzle assembly described above and the device described above, a plasma jet can be generated whose intensity is on the one hand sufficient to treat the nonwoven fabrics so that their strike-through time is reduced, and on the other hand not too strong, so that the nonwoven fabrics are not damaged. Similarly, the described nozzle assembly and device have also been found to be well suited for plasma treating other delicate fabrics, thin plastic films, or thin metal films which would be damaged by a plasma jet from a conventional plasma nozzle. Accordingly, the nozzle assembly or the device is preferably used for the plasma treatment of fabrics or films, in particular plastic films or metal films.

The nozzle assembly is intended for a device for generating an atmospheric plasma jet. The nozzle assembly may for example be formed integrally with such a device. Alternatively, the nozzle assembly can also be designed as a separate component, which can be detachably connected, for example, to the rest of the device, for example in a device for generating an atmospheric plasma jet with an exchangeable nozzle head or exchangeable nozzle assembly.

The nozzle assembly comprises an inlet. For example, if the nozzle assembly is formed as an integral part of a device for generating an atmospheric plasma jet, the inlet may also be a merely virtual passage from the rest of the device to the nozzle assembly without the need for a physical interruption between the rest of the device and the nozzle assembly.

Through the inlet, an atmospheric plasma jet can be introduced into the nozzle assembly. For this purpose, the nozzle assembly is preferably connected or connectable to a device for generating an atmospheric plasma jet in such a way that, during operation, the plasma jet passes through the inlet into the nozzle assembly. Preferably, in the region of the inlet, the nozzle assembly has corresponding coupling means, such as a thread, for connecting the nozzle assembly to a device for generating an atmospheric plasma jet.

The nozzle assembly comprises a channel connected to the inlet such that a plasma jet introduced through the inlet into the nozzle assembly is directed through the channel. The channel may, for example, have a circular or semicircular cross section.

Along the channel multiple nozzle openings are provided in the channel wall. For this purpose, the channel preferably has a substantially straight channel section, in which the nozzle openings are arranged one behind the other. The number of nozzle openings can be selected as required, wherein the intensity of the individual partial jets can be reduced by increasing the number of nozzle openings. Preferably, however, at least five, more preferably at least ten nozzle openings are provided in the channel in order to achieve an attenuation of the partial jet intensities suitable for the treatment of delicate materials, preferably delicate fabrics and films, in particular plastic films or metal films. The nozzle openings may, for example, be circular, oval, slit-like or also have a different geometry.

Through the nozzle opening, a plasma jet directed through the channel can emerge from the nozzle assembly. The nozzle openings thus lead out of the channel to the outside. The plasma jet conducted through the channel then penetrates through the nozzle openings to the outside, so that it emerges from the nozzle assembly in the form of a plurality of partial jets. This distribution of the plasma jet into a plurality of partial jets on the one hand results in enabling the plasma jet to act over a greater width. On the other hand, this allows the intensity of the individual partial jets to be reduced in such a way that delicate fabrics, in particular nonwoven fabrics, or thin plastic or metal films are not damaged by the partial jets, but can nevertheless be effectively plasma-treated.

The device for generating an atmospheric plasma jet comprises a discharge space and is configured to generate an atmospheric plasma jet in the discharge space. Such devices are in principle known from the prior art, for example from DE 195 32 412 C2.

The device has in particular a housing, for example a tubular housing, in which the discharge space is provided.

The atmospheric plasma jet is preferably generated in the discharge space by means of an electrical discharge in a working gas flow. The electrical discharge causes excitation and partial ionisation of the working gas, so that a plasma forms, which emerges from the discharge space as a plasma jet through the working gas flow.

For this purpose, the discharge space in particular comprises a gas inlet, through which the working gas flow can reach the discharge space. For the electrical discharge, an inner electrode is preferably arranged in the discharge space. Furthermore, an outer electrode is preferably provided which can be formed, for example, by the housing itself, for example by a metal tube used as a housing.

The nozzle assembly described above is connected to the discharge space. For this purpose, the housing and the nozzle assembly can comprise corresponding connecting means, for example threads, with which the nozzle assembly can be connected to the discharge space such that a plasma jet generated in the discharge space is passed through the inlet of the nozzle assembly.

According to a second teaching, the abovementioned object is furthermore achieved according to the invention by the use of the previously described device for the plasma treatment of a material, in particular a fabric or a film, in particular a plastic film or a metal film. The fabric may in particular be a nonwoven fabric.

Furthermore, the abovementioned object is achieved according to the invention by a method for plasma treatment of a fabric or a film, in particular a plastic film or metal film, using the previously described device, in which an atmospheric plasma jet is produces with the device so that the plasma jet emerges from the nozzle openings in the channel walling in the form of a plurality of partial jets, and in which a surface of a fabric or a film, in particular a plastic film or metal film, is impinged by the partial jets of the plasma jet.

By dividing the plasma jet into individual partial jets, on the one hand, a wider area of the fabric or the film, in particular the plastic film or the metal film, can be treated simultaneously, so that higher throughputs in the plasma treatment can be achieved. On the other hand, an intensity of the individual partial jets can be achieved so that the fabric or the film, in particular the plastic film or the metal film, can be effectively plasma-treated without its being damaged. In particular, it is possible for the temperature of the fabric or of the film during the plasma treatment to be consistently below 100° C. or even below 50° C.

For generating the plasma jet, for example, air, hydrogen and nitrogen mixtures, nitrogen or noble gases can be used as the working gas. Preference is given to using nitrogen ($N_2$) or noble gases, in particular argon, as the working gas, if appropriate also in combination, since in this way the lifetime of the plasma species in the plasma jet is prolonged so that the plasma still has sufficiently high activity even after passing through the channel. When nitrogen is used as the working gas, the nitrogen concentration in the working gas is preferably at least 98% by weight, in particular at least 99.5% by weight.

The material to be treated, in particular the fabric or the film to be treated, is preferably supplied as a web-type material, for example by a roller or in a production line, and is transported past the nozzle assembly, so that the partial jets exiting from the nozzle openings reach the material, in particular the fabric or the film.

The fabric is preferably a nonwoven fabric, which may in particular consist substantially of synthetic fibres, for example polypropylene or polyethylene fibres, of natural fibres, for example cotton or viscose fibres, and/or of inorganic fibres, for example glass fibres. It has been found that the plasma treatment of a nonwoven fabric with the method described above causes functional groups to form on the individual fibres of the nonwoven fabric, which increases the hydrophilicity of the fibres, so that the fabric can better absorb liquid.

Furthermore, it has been shown that the plasma treatment with the described method results in the thickness of the nonwoven fabric increasing with a corresponding reduction in the density. In experiments, increases in thickness by a factor of five were observed. It has been found that this leads to a shorter strike-through time of the nonwoven fabric. This can be explained by the fact that, with an increase in thickness and a decrease in density, capillaries increasingly form substantially perpendicular to the fabric direction, so that liquid can be transported through the nonwoven fabric more quickly. These effects result in a shorter strike-through time of the nonwoven fabric.

In experiments, a reduction to half or even one third of the original strike-through time of the untreated nonwoven fabric could be achieved with the plasma treatment. For example, with a thin low-cost nonwoven fabric having a surface weight of 30 g/m$^2$, strike-through times corresponding to those of a high-quality nonwoven fabric having a surface weight of 90 g/m$^2$ could be achieved by plasma treatment. Thus, with this method, lightweight, inexpensive nonwoven fabrics can be produced with good strike-through time.

Accordingly, the surface weight of the nonwoven fabric, in particular of the ADL or AQL, is preferably less than 90 g/m$^2$, in particular less than 50 g/m$^2$. The described plasma treatment of thin nonwoven fabrics increases the thickness of the nonwoven fabrics and improves their strike-through time, in particular to values that could so far only be achieved by nonwoven fabrics with a higher surface weight. The thickness of the nonwoven fabric before the plasma treatment is preferably less than 5 mm.

Experiments have also shown that the increase in thickness of the nonwoven fabric caused by the plasma treatment is very stable and is maintained both over time and under high pressure. In experiments, the thicknesses of the plasma-treated nonwoven fabrics also remained under pressures of 50,000 to 300,000 Pa, which corresponds to the typical pressures in a diaper package, since the diapers are heavily compressed during packaging. After releasing the pressure, the nonwoven fabrics again substantially assumed their previous thickness after the plasma treatment.

Furthermore, it was found that the properties of the nonwoven fabrics plasma-treated with the described method are retained over a long period of time, in particular because the plasma jet penetrates deep into the nonwoven fabric, whereas superficial corona treatment leads only to short-term effects.

Accordingly, the abovementioned object is also achieved according to the invention by a plasma-treated nonwoven fabric, in particular ADL or AQL, produced by a method comprising the following steps: providing a nonwoven fabric and plasma treating the nonwoven fabric by the method described above. Furthermore, the abovementioned object is achieved according to the invention by a sanitary product for absorbing liquids, in particular a sanitary napkin, diaper or pad, comprising a layer of the plasma-treated nonwoven fabric described above. Due to the improved strike-through time, such sanitary products have a higher quality coupled with low production costs.

A nonwoven fabric plasma-treated with the method described can be differentiated from untreated nonwoven fabrics of the same type, in particular by the lower density caused by the plasma treatment and by the hydrophilisation through the functional groups on the fibres caused by the plasma treatment. If, for example, an ADL/AQL material normally has a density of 90 kg/m$^3$, the density of the plasma-treated material is in particular less than 45 kg/m$^3$. Hydrophilisation can be detected by measuring the contact angle of water on the fibres. In the case of plasma-treated nonwoven fabrics, this is in particular less than 40° (measured directly on the fibres of the nonwoven fabric), while it is higher than this on untreated nonwoven fabrics. The functional groups on the fibres can also be detected directly, for example by means of X-ray photoelectron spectroscopy (XPS).

Furthermore, the method is suitable for plasma treatment of films, in particular plastic films or metal films. By the plasma treatment of films, these can be prepared for a subsequent printing process or a gluing of the films. The method achieves good hydrophilisation of the film surface without damaging the film. In contrast, previous attempts at treatment of films with dielectrically impeded discharges led to only minor improvements in hydrophilisation (to a maximum of 40 to 55 mN/m). The use of conventional plasma nozzles often led to damage of the films because of the high thermal load. The method is particularly suitable for thin films having a thickness of preferably less than 0.1 mm, more preferably less than 0.05 mm, in particular less than 0.02 mm.

In the following, various embodiments of the nozzle assembly, the device, the use, the method, the plasma-treated nonwoven fabric and the sanitary product for absorbing liquids will be described, wherein the individual embodiments are in each case applicable for the nozzle assembly, the device, the use, the method, the plasma-treated nonwoven fabric and the sanitary product for absorbing liquids. Furthermore, the individual embodiments can also be combined with each other.

In one embodiment, the channel has a straight section and the nozzle openings are arranged in the channel wall in the extension direction of the channel. In this way, a curtain of partial jets arranged side by side can be produced, so that a nonwoven fabric or a film can be treated simultaneously over a large width.

The nozzle openings are preferably arranged over a length of the channel of at least 50 mm, preferably at least 80 mm, in order to produce a wide plasma curtain and to distribute the intensity of the plasma jet over a larger area, so that the thermal load of the treated material is reduced.

In another embodiment, the channel is connected on both sides to the inlet, such that a plasma jet introduced into the nozzle assembly through the inlet is conducted into the channel from both sides. In particular, the channel has a first and a second end respectively connected to the inlet. Preferably, for this purpose, a distribution channel is provided between the inlet and the channel, through which the plasma jet is directed to both ends of the channel. The two-sided introduction of the plasma jet into the channel causes a more uniform distribution of the plasma jet intensity to the individual partial jets. In particular, the intensity is prevented from decreasing continuously from one end to the other end of the channel. As a result, a more uniform plasma treatment can be achieved.

In another embodiment, a gas supply is provided to direct a gas, preferably nitrogen, separately from the plasma jet into the channel. For this purpose, the channel preferably has an additional gas inlet, to which a gas supply can be connected. In a corresponding embodiment of the method, a gas, preferably nitrogen, is introduced separately into the channel in addition to the plasma jet. In this way, an additional cooling of the plasma jet is achieved, so that even more gentle treatment, in particular of delicate nonwoven fabrics, is possible with the partial jets emerging from the nozzle openings of the nozzle assembly.

In a further embodiment, the diameter of the nozzle openings in the channel walling is at most a quarter of the channel diameter. In this way, an excessive pressure drop is prevented in the channel, so that the partial jets have a more uniform intensity.

In a further embodiment, the cross section of the channel widens as the distance from the inlet increases. It has been recognised that this measure can counteract a pressure drop in the channel, so that partial jets of uniform intensity can be achieved.

In a further embodiment, the nozzle assembly is formed in several parts with a nozzle element which comprises the channel with the nozzle openings, and with a distributor element which comprises a distribution channel through which a plasma jet introduced through the inlet is conducted to the channel on one or both sides. In this way, the nozzle assembly can be manufactured more easily. For example, the nozzle element may have a groove introduced into a surface, which in the assembled state forms the channel with the remaining parts of the nozzle assembly. As a result, the channel running inside the nozzle assembly can be made simpler. The distributor element may, for example, have two parts which each have a groove on the surface, resulting in the grooves in the assembled state of the distribution channel. Also in this way, the nozzle assembly can be manufactured more easily.

The distribution channel of the distributor element preferably has an inlet and two outlets connected to the inlet for directing the plasma jet from the one inlet to both ends of the channel.

In a further embodiment, the nozzle assembly comprises a heat sink, in particular a heat sink with cooling fins for air cooling. In this way, the heat introduced by the plasma jet into the nozzle assembly can be emitted better to the outside, so that the nozzle assembly does not heat up too much. Furthermore, in this way, the temperature of the partial jets of the plasma jet can be reduced.

In another embodiment, the cross section of the channel in the region of a nozzle opening is shaped such that a virtual medial plane, which runs in the middle between a virtual first tangent plane of the cross section through the nozzle opening and a virtual second tangent plane of the cross section opposite thereto and parallel to the first tangent plane, divides the cross section into a first cross-sectional area at the nozzle opening and a second cross-sectional area opposite the nozzle opening, wherein the cross-sectional surface of the first cross-sectional area differs from the cross-sectional surface of the second cross-sectional area, preferably by at least 5%, in particular at least 10%.

It was found that such an asymmetry of the channel cross section allows a more uniform distribution of the plasma jet intensity to the individual partial jets. In the described asymmetry, the channel cross section in the region of a nozzle opening up to half its height above the nozzle opening has a different cross-sectional surface than in the remaining region of the channel cross section.

This embodiment defines the cross section of the channel in the region of a nozzle opening. However, the channel preferably has a corresponding cross section in the region of multiple nozzle openings, preferably along its course from the first to the last nozzle opening.

The channel cross section is divided by a virtual medial plane. This virtual medial plane is not actually present but merely serves to define the first and second cross-sectional areas whose cross-sectional surfaces are compared with one another.

The virtual medial plane extends in the centre between a virtual first tangent plane of the cross section through the nozzle opening and a virtual second tangent plane of the cross section opposite thereto and parallel to the first tangent plane. The position of the medial plane as central between two planes is understood to mean that the medial plane has the same distance from the first and the virtual second tangent plane. A tangent plane of the cross section is understood to mean a plane which touches the cross section of the channel but does not intersect it. The first tangent plane of the cross section passes through the nozzle opening, i.e. through the point where the nozzle opening meets the channel. The second tangent plane is opposite the first tangent plane. The cross section of the channel is therefore located between the first and the second tangent plane. Like the medial plane, the first and second tangent planes are virtual and serve to define the likewise virtual medial plane.

In one embodiment, the cross section of the channel has two opposite circular segments with different radii. Such a cross section can be produced simply, for example, by two mutually offset, parallel bores with different drill diameters. As a result, the manufacturing costs can be kept low.

In a further embodiment, the cross-sectional surface of the second cross-sectional area is greater than the cross-sectional surface of the first cross-sectional area. In this way, a particularly uniform distribution of the plasma jet intensity to the individual partial jets could be achieved. If, for example, the cross section of the channel has two opposite circular segments with different radii, the nozzle opening is preferably arranged in the region of the circular segment with the smaller radius, in particular in its vertex.

In a further embodiment, the nozzle assembly is formed in several parts with a first part, in the surface of which a first recess is introduced, and with a second part, in the surface of which a second recess is introduced, wherein the first and the second part adjoin each other such that the first and second recesses face are opposite each other and form the channel. In this way, the first recess forms a first part of the channel cross section and the second recess forms a second part of the channel cross section. If the two recesses are arranged opposite one another, this results in the entire cross section of the channel.

This embodiment allows a particularly simple manufacture of the channel. This is particularly advantageous if the channel has an asymmetrical cross section, for example corresponding to one of the previously described embodiments with a first and second cross-sectional area, which have different cross-sectional surfaces, or if the channel has a, for example, tapered cross section changing along its extension direction. In addition to the first and second parts, the nozzle assembly may also have further parts.

By way of example, the first part of the nozzle assembly may be a nozzle element comprising the nozzle openings. The nozzle openings then preferably emanate from the first recess.

The second part of the nozzle assembly may, for example, be a distributor element which comprises a distribution channel through which a plasma jet introduced through the inlet is conducted on one or both sides of the channel.

In one embodiment, the first part of the nozzle assembly has a recess with a circular segment-shaped cross section having a first radius, and the second part of the nozzle assembly has a recess with a circular segment-shaped cross section having a second radius that is different from the first radius. The adjoined first and second recesses then result in a cross section of two opposite circular segments of different radii. Preferably, the second radius is smaller than the first radius.

In a further embodiment, the device is configured to generate an atmospheric plasma jet by means of an arc-like discharge in a working gas, wherein the arc-like discharge can be generated by applying a high-frequency high voltage between electrodes. In a corresponding embodiment of the method, the atmospheric plasma jet is generated by means of an arc-like discharge in a working gas, wherein the arc-like discharge is generated by applying a high-frequency high voltage between electrodes.

The working gas used is preferably nitrogen ($N_2$) or a noble gas such as argon (Ar) or helium (He) or a nitrogen and inert gas mixture.

A high-frequency high voltage is typically understood to mean a voltage of 1-100 kV, in particular 1-50 kV, preferably 2-20 kV, at a frequency of 1-300 kHz, in particular 1-100 kHz, preferably 10-100 kHz, more preferably 10-50 kHz. In this way, a reactive plasma jet can be generated, which enables effective plasma treatment, in particular of nonwoven fabrics, so that their strike-through time is reduced. At the same time, a plasma jet generated in this way has a comparatively low temperature. As a result of the additional division of the plasma jet into a plurality of partial jets, this results in an intensity of the partial jets which avoids damage to delicate materials such as fabrics and plastic films.

In a further embodiment, the device has an inner electrode arranged within the discharge space. In particular, a high-frequency high voltage can be applied between the inner electrode and the housing in order to generate an arc-like discharge in a working gas flowing through the discharge space, so that a plasma jet is formed. Devices with such an inner electrode allow the generation of a stable discharge and thus a stable plasma jet.

In another embodiment, the device is used for the plasma treatment of a nonwoven fabric, in particular for or in the manufacture of diapers, sanitary napkins or pads. It has been found that the device is particularly suitable for the plasma treatment of thin nonwoven fabrics, such as those used in the manufacture of diapers, sanitary napkins or pads, in particular ADL or AQL, since these delicate materials can be effectively plasma-treated in this way without their being damaged or destroyed.

In a further embodiment, the material, in particular the fabric or the film, in particular the plastic film or metal film, is a web-type material and is transported past the nozzle openings of the device. In this way, the device or the method can easily be integrated into a process line, for example in a process line for the production of nonwoven fabrics for sanitary products or in a process line for the production of sanitary products themselves. The juxtaposed nozzle openings are preferably located transverse to the transport direction, so that the fabric or the plastic film can be treated over a corresponding width. In this way, the fabric or the plastic film can be plasma-treated with high throughput. In laboratory tests, a reduction of the strike-through time of the nonwoven fabric by more than 25% was achieved even with the use of a single device and a throughput of 60 m of nonwoven web per minute. Through the use of multiple devices, for example four devices with four corresponding nozzle assemblies, the throughput can increase, for example to 240 m/min, so that the typical production throughputs can be achieved in the production of nonwoven fabrics for sanitary products.

It is also conceivable that this device or this method can be used in principle to post-treat ready-made sanitary products such as sanitary napkins, diapers or pads in order to achieve the desired quality improvement of the sanitary products.

The material, in particular the fabric or the film, in particular the plastic film or metal film, can be plasma-treated over its entire width. Alternatively, the material, in particular the fabric or the film, in particular plastic film or metal film, can also be plasma-treated only over a partial area of its width. This is particularly advantageous for nonwoven fabrics for the production of sanitary products for absorbing liquids. For example, if only an area in the middle of the nonwoven fabric is plasma treated, while strips at the sides remain untreated, then an absorbing and distribution layer can be produced from this nonwoven fabric, which is highly hydrophilic in the centre so as to quickly absorb liquids, but is less hydrophilic on the sides, so that at the edge of the diaper or sanitary napkin no liquid can escape to the outside. Accordingly, the method described also permits a targeted plasma treatment of individual regions of a nonwoven fabric or, in general, a fabric or a plastic film.

In accordance with the method, a region of the fabric, in particular a nonwoven fabric, is preferably plasma-treated, which is provided on the sanitary product produced for absorbing and/or distributing liquid, in particular for passing a liquid to a layer arranged below the region of the fabric, in particular a superabsorbent layer. In a corresponding embodiment of the sanitary product, the layer of plasma-treated nonwoven fabric is plasma-treated in a region which is provided for absorbing and/or distributing liquid, in particular for passing a liquid to a layer arranged below this region, in particular a superabsorbent layer in the middle of a diaper or a sanitary napkin, which is arranged for example between hydrophobic or liquid-impermeable areas.

In a further embodiment, the fabric or the film, in particular plastic film or metal film, is transported via two rollers with the same rotational speed, the device being arranged between the two rollers. Additionally or alternatively, the fabric or the film, in particular the plastic film or metal film, is transported over a treatment table, for example an aluminium plate, in the region of the plasma treatment. By the aforementioned measures, tensile forces on the fabric or the film, in particular the plastic film or metal film, during the treatment can be minimised, whereby damage to the fabric or the film, in particular the plastic film or metal film, during the plasma treatment can be avoided. In the transport direction behind the area of the plasma treatment, a suction can be provided in order to suck off nitrogen oxides or ozone generated during the plasma jet generation. For example, the suction can be integrated into the treatment table.

In a further embodiment, the device comprises a rotary actuator, which is configured to rotate the nozzle assembly about an axis of rotation during operation. In this way, the exposure area of the partial jets of the plasma jet emerging from the nozzle openings can be increased. The axis of rotation may, for example, be aligned substantially perpendicular to the extension direction of the channel or parallel to the partial jets emerging from the nozzle openings, so that the partial jets cover a substantially circular area during the rotation of the nozzle assembly.

Alternatively, the axis of rotation may also be aligned substantially parallel to the extension direction of the channel. This allows, for example, an internal treatment of a pipe surface.

In a further embodiment, the material, in particular the fabric or the film, is impinged with the partial jets of the plasma jet under atmospheric pressure. It has been recognised that even delicate materials such as, for example, fabrics, in particular nonwoven fabrics, or film, in particular plastic or metal film, can be treated without damage under atmospheric pressure with the partial jets emerging from the nozzle assembly. As a result, in particular, it is not necessary to arrange the material to be treated and/or the nozzle assembly in a vacuum chamber.

In contrast, in other plasma treatment techniques in the prior art, delicate materials have been placed in a vacuum chamber to achieve sufficient plasma attenuation for damage-free treatment of delicate materials. In addition to the additional costs for the vacuum chamber, this increases the cost of performing the plasma treatment due to the required input and output operations of the material to be treated.

Since a treatment of even delicate materials in the atmospheric pressure is made possible with the device described above or with the nozzle assembly described, it is possible to dispense with a vacuum chamber for the material to be treated, so that the method can be carried out simply and cost-effectively. In particular, the method can be performed inline, i.e. within a continuously operated process line, since no input and output operations into a decompression chamber or vacuum chamber are required, which interrupt the continuous operation.

Hereinafter, further Embodiments 1 to 9 of the nozzle assembly, Embodiments 10 and 11 of the device, Embodiments 12 and 13 of the use, Embodiments 14 to 16 of the method, Embodiment 17 of the plasma-treated nonwoven fabric and Embodiment 18 of the sanitary product will be described.

1. Nozzle assembly for a device for generating an atmospheric plasma jet comprising an inlet through which an atmospheric plasma jet can be introduced into the nozzle assembly, and comprising a channel which is connected to the inlet such that a plasma jet introduced into the nozzle assembly through the inlet is conducted through the channel, wherein multiple nozzle openings are provided in the channel wall along the channel, through which a plasma jet directed through the channel can exit the nozzle assembly.
2. Nozzle assembly according to Embodiment 1, wherein the channel has a straight section, and the nozzle openings are arranged in the channel wall in the extension direction of the channel.
3. Nozzle assembly according to Embodiment 1 or 2, wherein the channel is connected on both sides to the inlet, such that a plasma jet introduced into the nozzle assembly through the inlet is conducted into the channel from both sides.
4. Nozzle assembly according to any one of Embodiments 1 to 3, wherein the diameter of the nozzle openings in the channel walling is at most a quarter of the channel diameter.
5. Nozzle assembly according to any one of Embodiments 1 to 4, wherein the cross section of the channel widens as the distance from the inlet increases.
6. Nozzle assembly according to any one of Embodiments 1 to 5, wherein the nozzle assembly is formed in several parts with a nozzle element, which comprises the channel with the nozzle openings, and with a distributor element, which comprises a distribution channel through which a plasma jet introduced through the inlet is conducted to the channel on one or both sides.
7. Nozzle assembly according to any one of Embodiments 1 to 6, wherein the cross section of the channel in the region of a nozzle opening is shaped in such a way that a virtual medial plane, which runs in the middle between a virtual first tangent plane of the cross section through the nozzle opening and a virtual second tangent plane of the cross section opposite thereto and parallel to the first tangent plane, divides the cross section into a first cross-sectional area at the nozzle opening and a second cross-sectional area opposite the nozzle opening, and wherein the cross-sectional surface of the first cross-sectional area differs from the cross-sectional surface of the second cross-sectional area, preferably by at least 5%, in particular by at least 10%.
8. Nozzle assembly according to Embodiment 7, wherein the cross-sectional surface of the second cross-sectional area is greater than the cross-sectional surface of the first cross-sectional area.
9. Nozzle assembly according to any one of Embodiments 1 to 8, wherein the nozzle assembly is formed in several parts with a first part, in the surface of which a first recess is introduced, and with a second part, in the surface of which a second recess is introduced, wherein the first and the second part adjoin each other such that the first and the second recess are opposite each other and form the channel.
10. Device for generating an atmospheric plasma jet comprising a discharge space, wherein the device is configured to generate an atmospheric plasma jet in the discharge space, and wherein a nozzle assembly according to any one of Embodiments 1 to 9 is connected to the discharge space in such a way that a plasma jet generated in the discharge space is introduced into the inlet of the nozzle assembly.
11. Device according to Embodiment 10, wherein the device is configured to generate an atmospheric plasma jet by means of an arc-like discharge in a working gas, wherein the arc-like discharge can be generated by applying a high-frequency high voltage between electrodes.
12. Use of a device according to Embodiment 10 or 11 for the plasma treatment of a material, preferably a fabric or a film, in particular a plastic film or a metal film.
13. Use according to Embodiment 12, wherein the device is used for the plasma treatment of a nonwoven fabric, in particular for or in the manufacture of diapers, sanitary napkins or pads.
14. Method for the plasma treatment of a material, preferably a fabric, in particular a nonwoven fabric, or a film, in particular a plastic film or a metal film, using a device according to Embodiment 10 or 11, in which an atmospheric plasma jet is produced with the device so that the plasma jet emerges from the nozzle openings in the channel walling in the form of a plurality of partial jets, and in which a surface of a material, preferably a fabric or a film, in particular a plastic film or a metal film, is impinged by the partial jets of the plasma jet.
15. Method according to Embodiment 14, wherein the material, in particular the fabric or the film, is a web-type material and is transported past the nozzle openings of the device.
16. Method according to Embodiment 14 or 15, wherein the material, in particular the fabric or the film, is impinged with the partial jets of the plasma jet under atmospheric pressure.
17. Plasma-treated nonwoven fabric, in particular ADL, produced by a method with the following steps:
    providing a nonwoven fabric,
    plasma treating the nonwoven fabric by a method according to any one of Embodiments 14 to 16.
18. Sanitary product for absorbing liquids, in particular sanitary napkins or diapers, comprising a layer of plasma-treated nonwoven fabric according to Embodiment 17.

Further features and advantages of the nozzle assembly, the device, the use, the method, the nonwoven fabric and the sanitary product will become apparent from the following description of various exemplary embodiments, wherein reference is made to the accompanying drawings.

DESCRIPTION OF THE INVENTION

Figure 1:
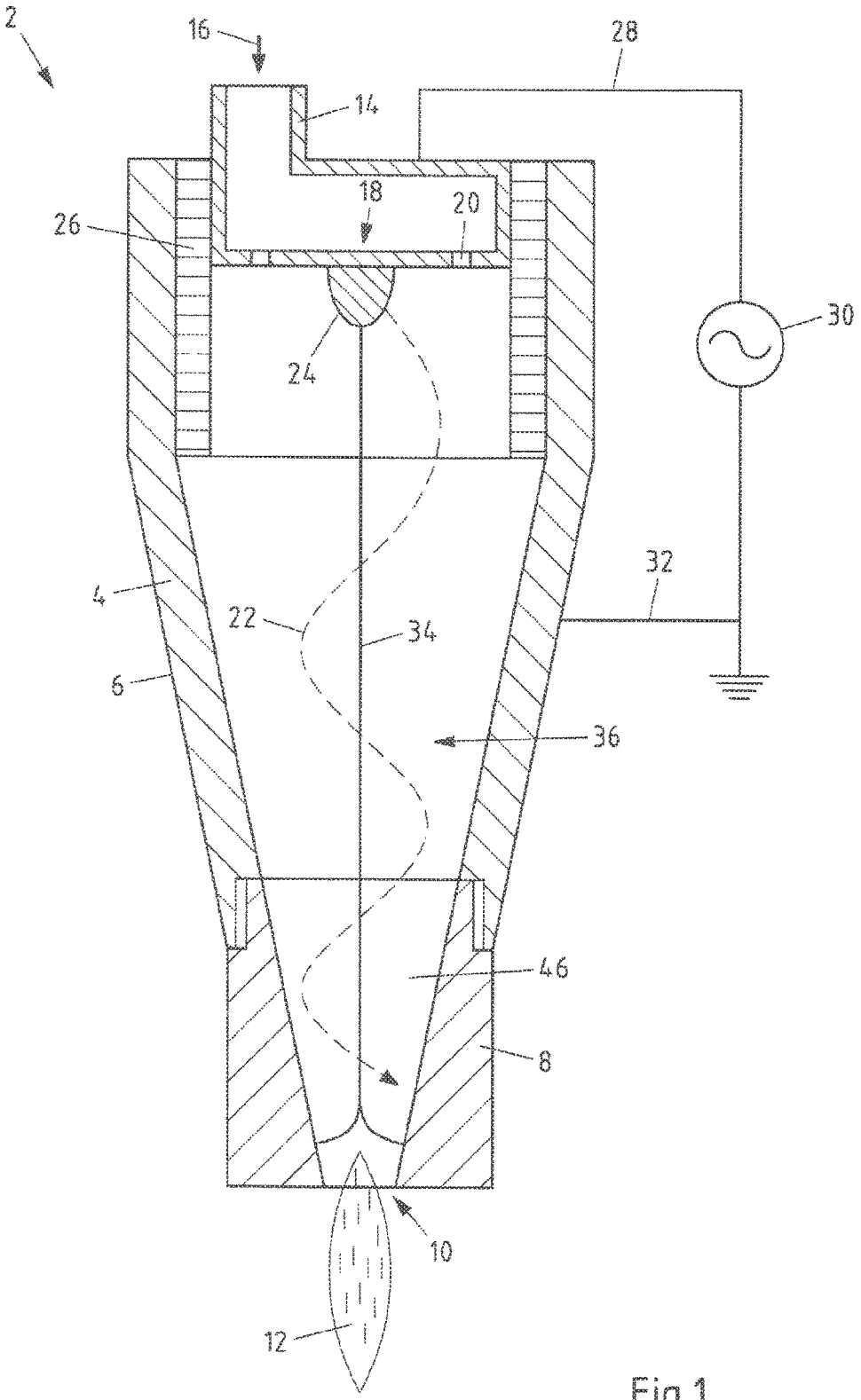
FIG. 1 shows a device for generating an atmospheric plasma jet.

In the following, the design and operation of a device for generating an atmospheric plasma jet will first be described.

The device 2 comprises a tubular housing 4 in the form of a metal nozzle tube. The nozzle tube 4 has at one of its ends a conical taper 6, on which a replaceable nozzle head 8 is mounted, the outlet of which forms a nozzle opening 10, from which the plasma jet 12 emerges during operation.

At the end opposite the nozzle opening 10, the nozzle tube 4 is connected to a working gas supply line 14. The working gas supply line 14 is connected to a pressurised working gas source (not shown) with variable flow rate. During operation, a working gas 16 is introduced from the working gas source through the working gas supply line 14 into the nozzle tube 4.

In the nozzle tube 4, a swirl device 18 is further provided with a rim of bores 20, arranged obliquely in the circumferential direction, through which the working gas 16 introduced into the nozzle tube 4 is swirled during operation.

The downstream part of the nozzle tube 4 is therefore perfused by the working gas 16 in the form of a vortex 22, whose core runs on the longitudinal axis of the nozzle tube 4.

In the nozzle tube 4, an inner electrode 24 is additionally centrally arranged, which extends in the nozzle tube 4 coaxially in the direction of the nozzle opening 10. The inner electrode 24 is electrically connected to the swirl device 18. The swirl device 18 is electrically insulated from the nozzle tube 4 by a ceramic tube 26. Via a high-frequency line 28, a high-frequency high voltage is applied to the inner electrode 24, which is generated by a transformer 30. The nozzle tube 4 is earthed via an earth line 32. The applied voltage generates a high-frequency discharge in the form of an electric arc 34 between the inner electrode 24 and the nozzle tube 4. This area in the nozzle tube 4 thus represents a discharge space 36 of the device 2.

The terms "arc", "arc discharge "and "arc-like discharge" are used herein as phenomenological descriptions of the discharge, since the discharge occurs in the form of an electric arc. The term "electric arc" is otherwise used as a discharge form in DC voltage discharges with substantially constant voltage values. In the present case, however, it is a high-frequency discharge in the form of an electric arc, i.e. a high-frequency arc-like discharge.

Due to the swirling flow of the working gas, this electric arc 34 is channelled in the vortex core in the region of the axis of the nozzle tube 4, so that it branches only in the region of the taper 6 to the wall of the nozzle tube 4.

The working gas 16, which rotates with high flow velocity in the region of the vortex core and thus in the immediate vicinity of the electric arc 34, comes into intimate contact with the electric arc 34 and is thereby partially transferred to the plasma state, so that an atmospheric plasma jet 12 emerges from the device 2 through the nozzle opening 10.

Figure 2:
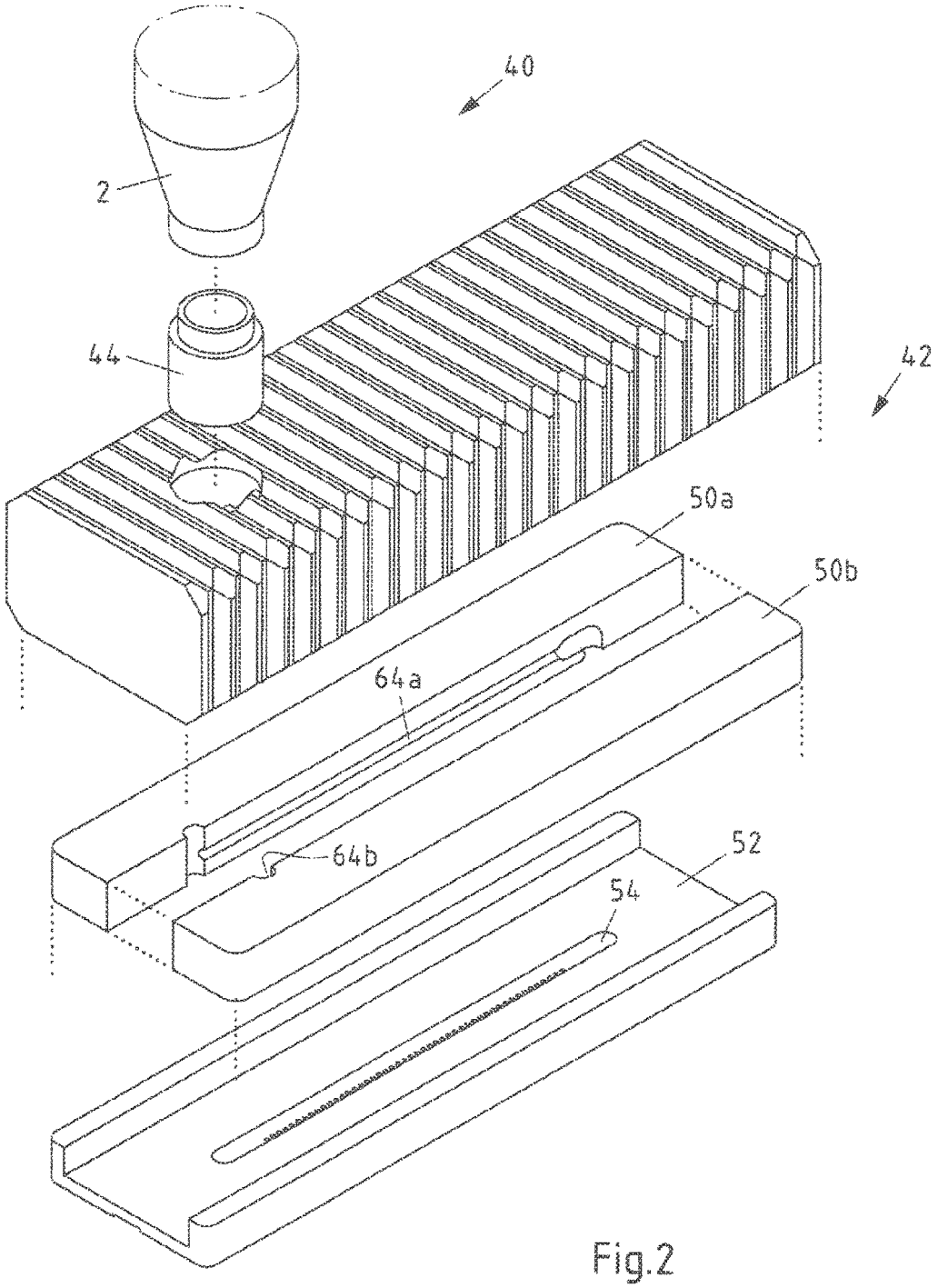
FIG. 2 shows an exemplary embodiment of the nozzle assembly according to the invention and an exemplary embodiment of the device according to the invention for generating an atmospheric plasma jet, in an exploded view.
Figure 3:
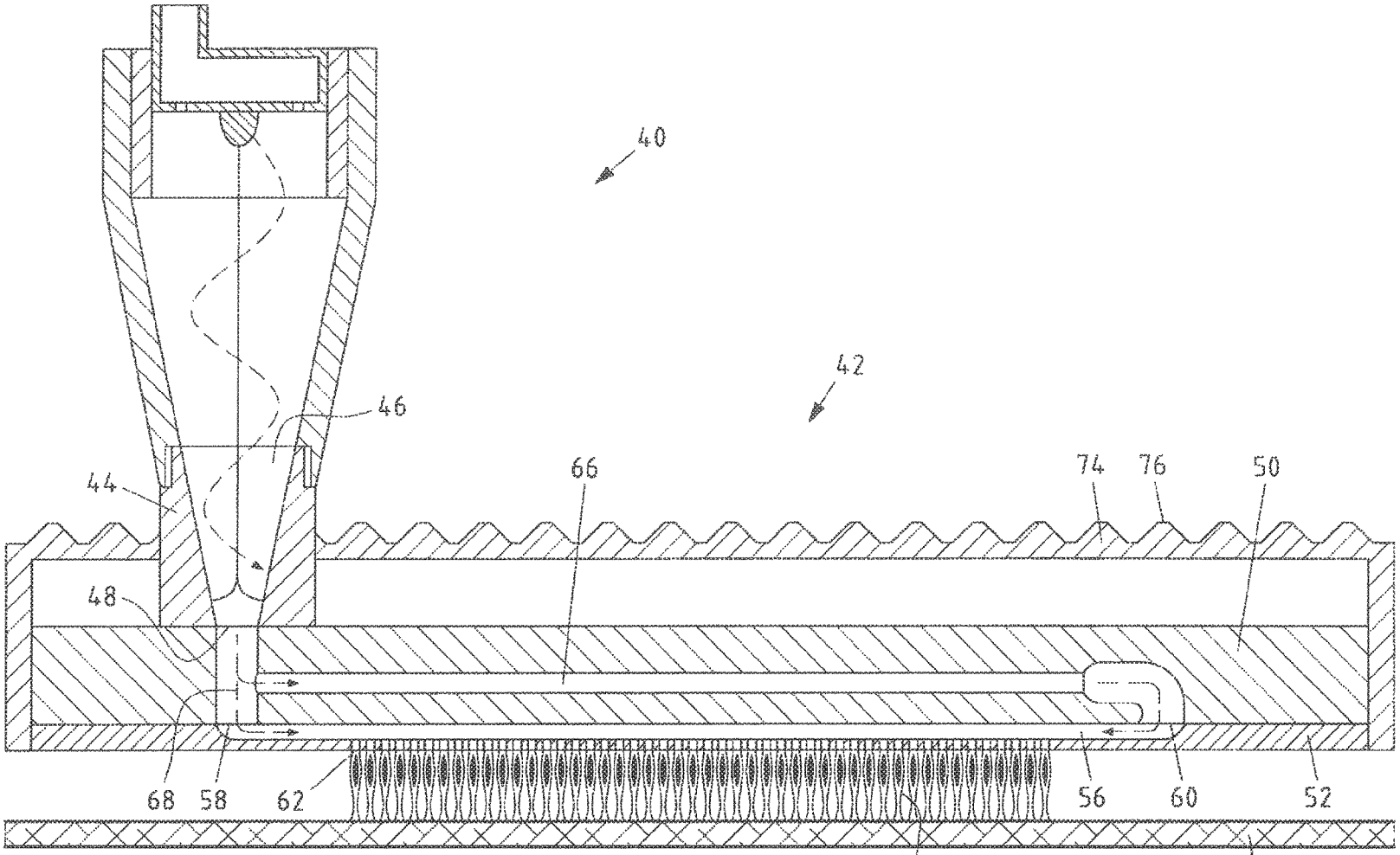
FIG. 3 shows the exemplary embodiment of the nozzle assembly and the exemplary embodiment of the device from FIG. 2 in a sectional view.

FIG. 2 shows an exemplary embodiment of the nozzle assembly according to the invention and an exemplary embodiment of the device according to the invention for generating an atmospheric plasma jet, in an exploded view. FIG. 3 shows the nozzle head and the device in a sectional view.

The device 40 comprises the nozzle assembly 42 and the device 2 from FIG. 1, wherein, instead of the exchangeable nozzle head 8, a connecting piece 44 of the nozzle assembly 42 is connected to the nozzle tube 4. The connecting piece 44 has a tapered inner channel 46, which forms the lower part of the discharge space 36 of the device 2. During operation, the plasma jet 12 emerges from the lower opening 48 of the connecting piece 44 and enters the further components of the nozzle assembly 42. Accordingly, the lower opening 48 may be considered as an inlet of the nozzle assembly 42.

The nozzle assembly 42 furthermore comprises a distributor element 50 composed of two parts 50*a-b* and a nozzle element 52. A groove 54 is introduced into the nozzle element 52, which forms a channel 56 having a first end 58 and a second end 60 in the assembled state of the nozzle assembly 42, as shown in FIG. 3. In the channel walling of the channel 56 multiple nozzle openings 62 are introduced along the channel side by side.

The parts 50*a-b* of the distributor element 50 have respective grooves 64*a-b* which in the assembled state form a distribution channel 66. The distribution channel has a branch 68 and connects the inlet 48 to both the first end 58 and the second end 60 of the channel 56.

When a plasma jet 12 is generated with the device 2 during operation, it passes through the inlet 48 at the connecting piece 44 into the distribution channel 66 and is thus conducted to both ends 58, 60 of the channel 56 and through the channel 56, so that it emerges from the nozzle assembly 42 in the form of a plurality of partial jets 70 from the nozzle openings 62. In this way, a curtain is generated of a plurality of partial jets 70 adjacent to one another, wherein the individual partial jets 70 have a reduced intensity in relation to the plasma jet 12, so that, for example, a nonwoven fabric 72 can be transported past the nozzle openings 62 for plasma treatment, without being damaged.

The fact that the plasma jet 12 is introduced via the distribution channel 66 into the channel 56 on both sides, causes the individual partial jets 70 to have a relatively similar intensity. Optionally, the intensity of the individual partial jets 70 can be further evened out by forming the channel with a cross section that widens slightly from both ends 58, 60 to the centre of the channel, thereby counteracting an excessive pressure drop in the case of longer distances to the inlet 48.

The nozzle assembly 42 also has an aluminium heat sink 74 with cooling fins 76 surrounding the other components, through which the heat load introduced into the nozzle assembly 42 by the plasma jet 12 can be dissipated.

Figure 4:
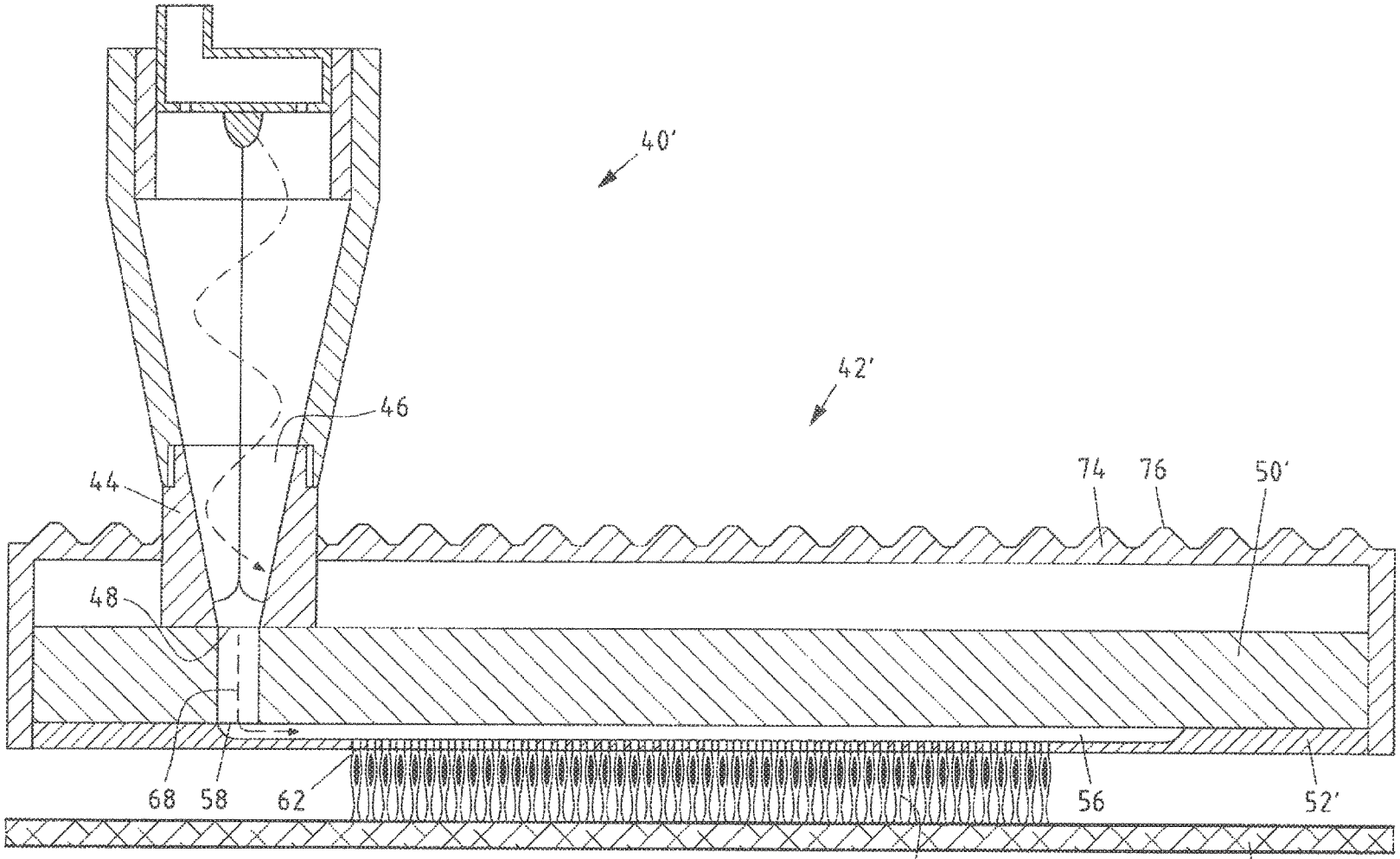
FIG. 4 shows an alternative exemplary embodiment of the nozzle assembly and the device in sectional view.

FIG. 4 shows an alternative exemplary embodiment of the nozzle assembly and the device in a sectional view. The device 40' and the nozzle assembly 42' are substantially structurally identical to the device 40 and the nozzle assembly 42, respectively. Identical parts are respectively provided with the same reference numerals.

The nozzle assembly 42' differs from the nozzle assembly 42 only in that the channel 56 is connected to the inlet 48 such that the plasma jet is directed into the channel 56 from one side. For this purpose, the distributor element 50' and the nozzle element 52' are formed as shown in FIG. 4.

To counteract an excessive pressure drop in the channel 56 and to equalise the intensities of the partial jets 70, the cross section of the channel 56 may optionally slightly expand as the distance from the inlet 48 increases (i.e. from left to right in FIG. 4).

Figure 5:
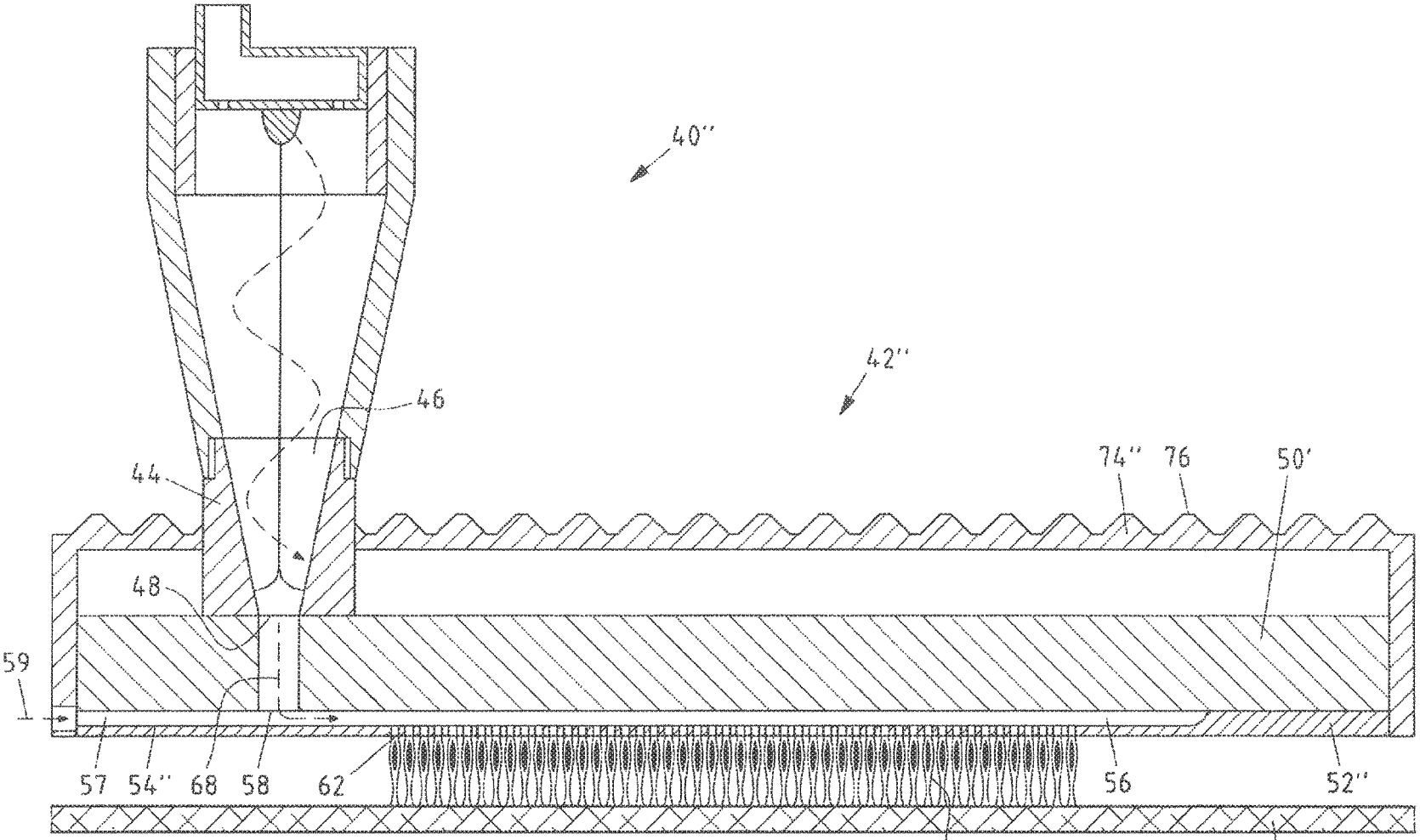
FIG. 5 shows a further alternative exemplary embodiment of the nozzle assembly and the device in sectional view.

FIG. 5 shows an alternative exemplary embodiment of the nozzle assembly and the device in a sectional view. The device 40" and the nozzle assembly 42" are substantially structurally identical to the device 40' and the nozzle assembly 42'. Identical parts are respectively provided with the same reference numerals.

The nozzle assembly 42" differs from the nozzle assembly 42' only in that an additional gas feed 57 is provided, through which a gas 59 can be introduced into the channel 56 separately from the plasma jet. For this purpose, the groove 54" extends as shown in FIG. 5 to the edge of the nozzle element 52" and an opening is provided in the heat sink 74" for introducing the gas 59 into the channel 56. By introducing the gas 59, in particular nitrogen, the plasma jet can additionally be cooled in the channel 56, so that the partial jets 70 emerging from the nozzle openings 62 enable a very gentle treatment of nonwoven fabrics.

Figure 6:
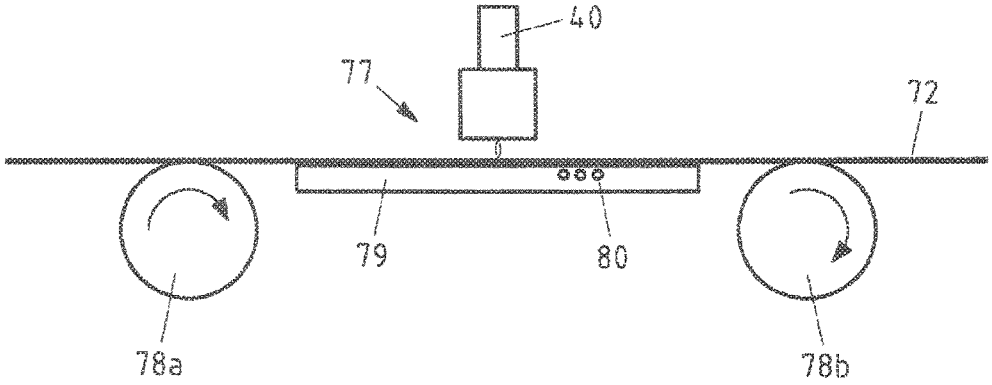
FIG. 6 shows an exemplary embodiment of the use according to the invention and of the method according to the invention.

FIG. 6 shows an exemplary embodiment of the use according to the invention and of the method according to the invention. In particular, the device 40 can be used to treat delicate nonwoven fabrics with plasma.

For this purpose, the web-type nonwoven fabric 72 may be transported past the nozzle openings of the device 40 (or alternatively also 40' or 40") as shown in FIGS. 3-5, in order to treat the nonwoven fabric 72 over its entire length. The nozzle openings are preferably arranged transversely to the transport direction of the nonwoven web 72, as illustrated in FIG. 4, so that the nonwoven fabric 72 can be treated with the device 40 over a certain width, optionally over the entire width or a partial width of the nonwoven web 72.

In order to further reduce the load on the nonwoven web 72 during the plasma treatment, the nonwoven web 72 is transported over rollers 78*a-b* respectively in front of and behind the treatment region 77 with the device 40, such that the rollers rotate at the same speed. In this way, tensile forces are reduced on the nonwoven web 72 in the treatment region 77. To further reduce the tensile forces, a treatment table 79 in the form of an aluminium plate is provided, over which the nonwoven web 72 is transported in the treatment region 77. In the transport direction behind the treatment region 77 suction openings 80 are provided in the treatment table 79, through which the ozone or nitrogen oxides can be sucked, which arise in the case of the preferred use of nitrogen as a working gas for the device 2 and 40 respectively.

Since the device 40 allows a damage-free treatment of delicate fabrics such as the nonwoven web 72 even under atmospheric pressure, the device can be operated as shown in FIG. 6 without a vacuum chamber. In particular, inline operation, in particular within a continuous process line, is possible because no input and output operations are required.

Figure 7:
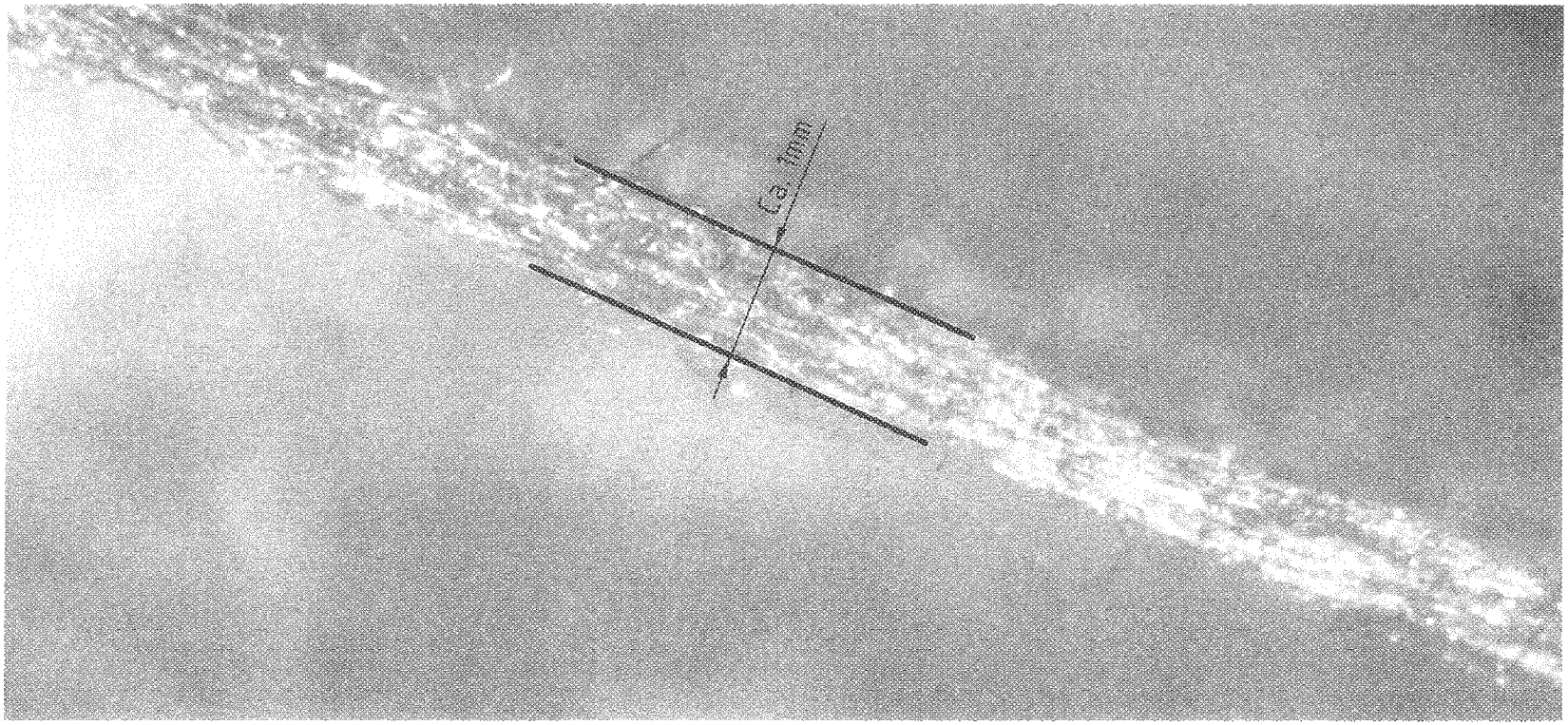
FIG. 7 shows a photograph of an untreated nonwoven fabric.

FIG. 7 shows a photograph of an untreated nonwoven fabric from the side. The nonwoven fabric comprises individual intertwined fibres, in particular plastic fibres, which produce a relatively compact fabric. The illustrated nonwoven fabric has a thickness of approx. 1 mm.

Figure 8:
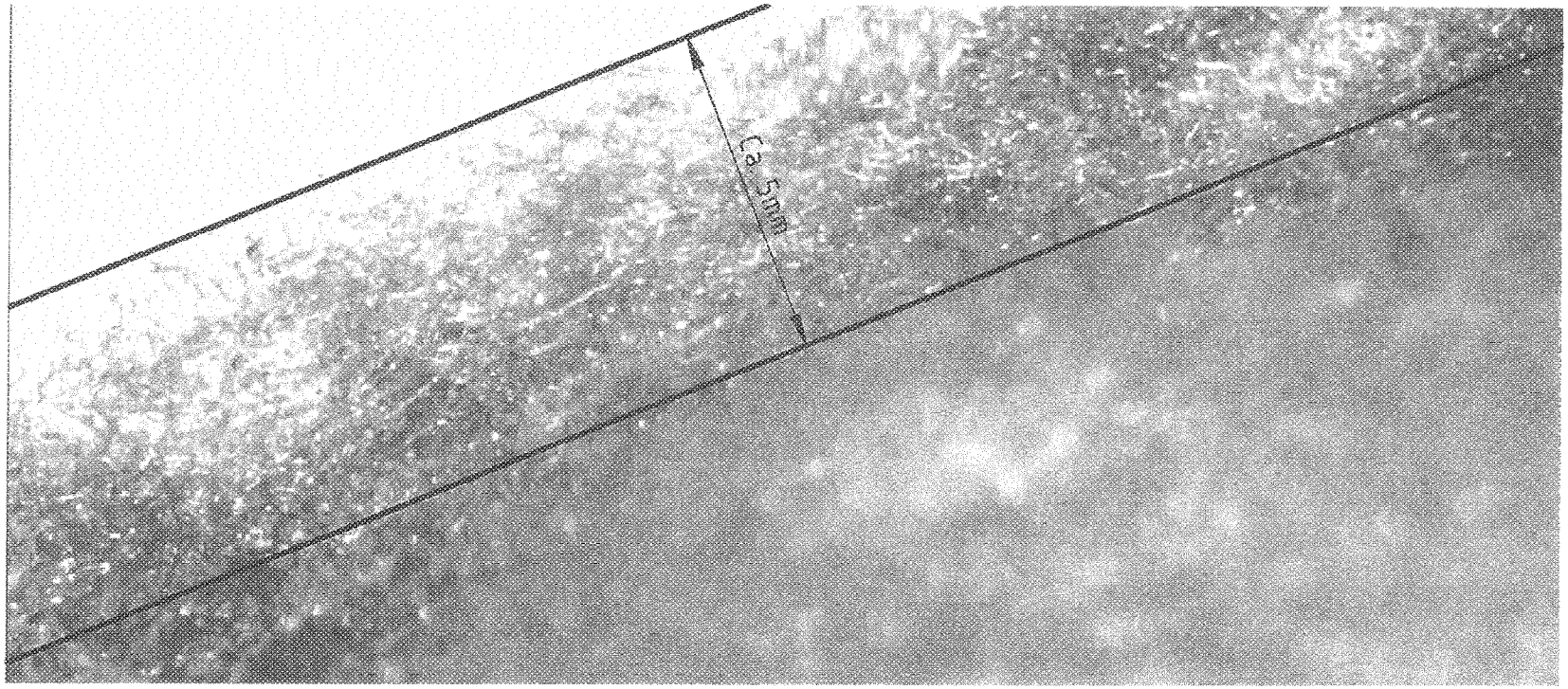
FIG. 8 shows a photograph of a plasma-treated nonwoven fabric as an exemplary embodiment of the plasma-treated nonwoven fabric according to the invention.

FIG. 8 shows a photograph of the nonwoven fabric of FIG. 7 after being plasma treated with the device 40 shown in FIG. 3. FIG. 8 thus shows an exemplary embodiment of the plasma-treated nonwoven fabric according to the invention. After the plasma treatment, the nonwoven fabric has a greatly increased thickness of approx. 5 mm and correspondingly a less compact structure with a lower density. It has been found that this leads to an improvement in the capillarity of the nonwoven fabric, so that liquids pass through the fabric more effectively. Furthermore, the plasma treatment achieves a hydrophilisation of the fibres, so that the fabric can absorb liquids faster.

Figure 9A:
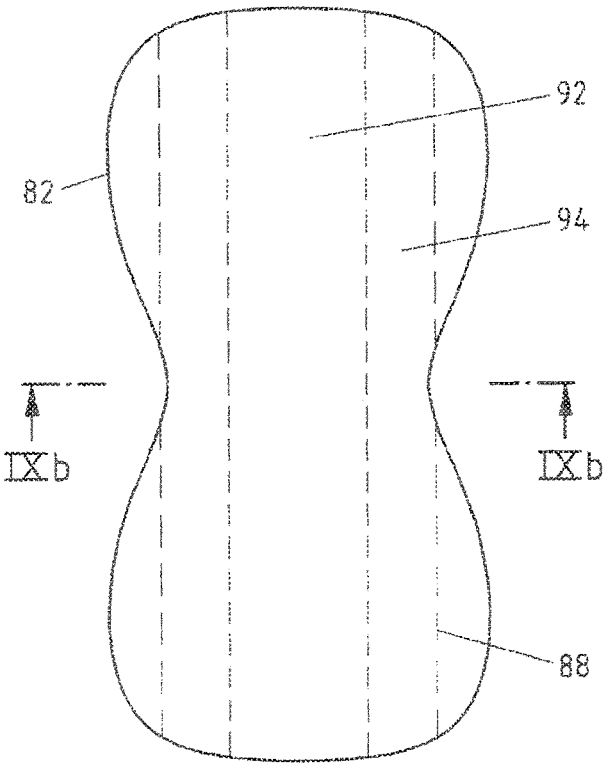
FIGS. 9*a-b* show an exemplary embodiment of the sanitary product according to the invention.
Figure 9B:
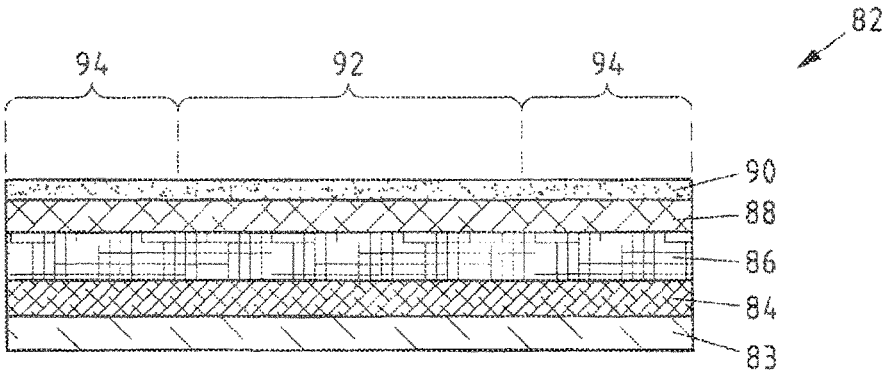

FIG. 9*a-b* now shows an exemplary embodiment of a sanitary product according to the invention for absorbing liquids, in plan view (FIG. 9*a*) and in cross section (FIG. 9*b*) along the sectional plane designated by "IXb" in FIG. 9*a*. In the present case, the sanitary product 82 is a sanitary napkin, but a corresponding design is also possible with a diaper or a pad.

The sanitary product 82 has a shaping outer layer 83, a superabsorbent layer 84 ('absorbent core'), a distribution layer (ADL/AQL) 86 made of plasma-treated nonwoven fabric, for example the nonwoven fabric 72 from FIG. 4, an absorption layer 88 made of nonwoven fabric treated in sections and a cotton layer 90 as a cover layer. The superabsorbent layer 84 may comprise, for example, liquid-absorbing powder, in particular superabsorbent polymers.

When used as intended, the cotton layer is in contact with the skin surface and ensures a pleasant skin sensation. The absorbent nonwoven fabric 88 arranged underneath is plasma-treated only in the middle 92, while the edges 94 are untreated. In this way, the absorbent nonwoven fabric 88 has hydrophilic properties in the centre 92, so that liquid is conducted effectively into the underlying distribution layer 86. On the edges 94, however, the absorbent nonwoven fabric 88 has hydrophobic properties, thereby preventing liquid from leaking at the edges of the sanitary product 82. The targeted plasma treatment in the centre 92 of the absorbent nonwoven fabric 88 can in particular replace the hydrophilisation used in the prior art, which is more complex in terms of process technology and because of the application of surfactants.

The distribution layer 86 arranged below the absorbent nonwoven fabric 88 distributes the liquid in the surface, so that the liquid then reaches the underlying absorbent core 84 having been distributed over a larger area. The plasma treatment of the absorbent nonwoven fabric 88 allows the liquid to be absorbed more quickly by the distribution layer 86.

Through the use of the plasma-treated nonwoven fabric 72 for the absorbent nonwoven fabric 88 and/or the distribution layer 86, the production costs of the sanitary product 82 can be reduced, since it is possible to achieve absorbing or distribution layers with a short strike-through time even with more cost-effective nonwoven fabrics 72.

Figure 10:
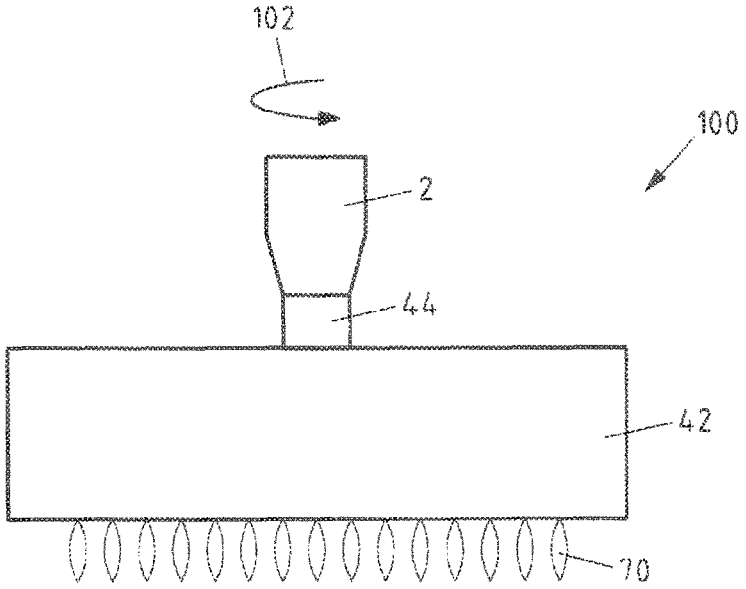
FIG. 10 shows a further exemplary embodiment of the nozzle assembly according to the invention and of the device according to the invention.
Figure 11:
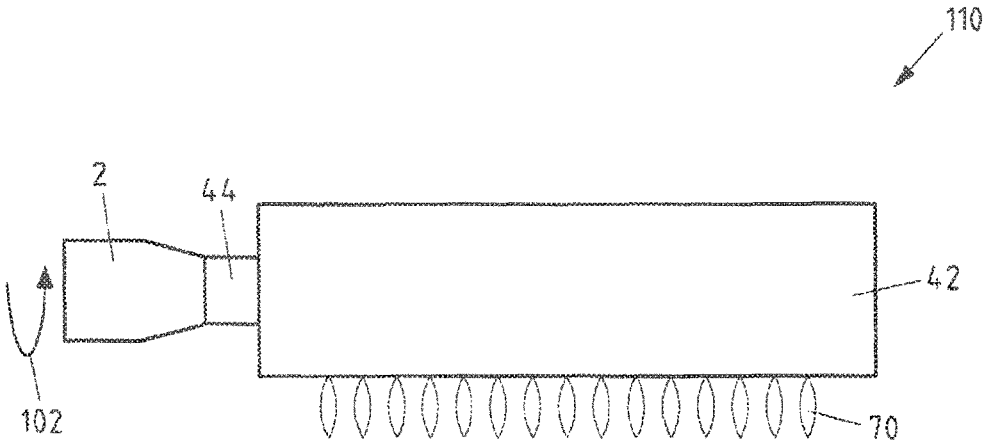
FIG. 11 shows a further exemplary embodiment of the nozzle assembly according to the invention and of the device according to the invention.

FIGS. 10 and 11 show further exemplary embodiments and possible uses of the device described above.

The device 100 shown in FIG. 10 has a similar configuration as the device 40 of FIG. 2, wherein the device 2 and the connecting piece 44, however, are positioned centrally to the nozzle assembly 42 and the distributor element 50 of the nozzle assembly 42 has a correspondingly configured course for the distribution channel 66. Alternatively, the device 100 may also be similar to the device 40' of FIG. 4 or the device 40" of FIG. 5.

The nozzle assembly 42 is rotatable by means of a rotary actuator 102 about an axis perpendicular to the extension direction of the channel 56. In this way, with the partial jets 70 emerging from the nozzle openings 62, a larger surface area can be treated, so that the device 100 can be used for the large-area plasma treatment 100. In particular, the device 100 can be used for the plasma treatment of a fabric, in particular a nonwoven fabric, or a plastic film.

FIG. 11 shows an alternative device 110, again of similar configuration to the device 40 of FIG. 2, but with the device 2 and connecting piece 44 positioned laterally on the nozzle assembly 42 and the distributor element 50 of the nozzle assembly 42 having a course of the distribution channel 66 correspondingly adapted. Alternatively, the device 110 may also be similar to the device 40' of FIG. 4 or the device 40" of FIG. 5.

The nozzle assembly 42 is rotatable about an axis parallel to the extension direction of the channel 56 by means of a rotary actuator 112. The device 110 can likewise be used for the plasma treatment of a fabric, in particular a nonwoven fabric, or a plastic film.

Furthermore, the device 110 may also be used for other purposes. In particular, a tubular component can be impinged from the inside with plasma, using the partial jets 70 projecting from the nozzle openings 62, for example, to treat a pipe inner wall with plasma.

Figure 12:
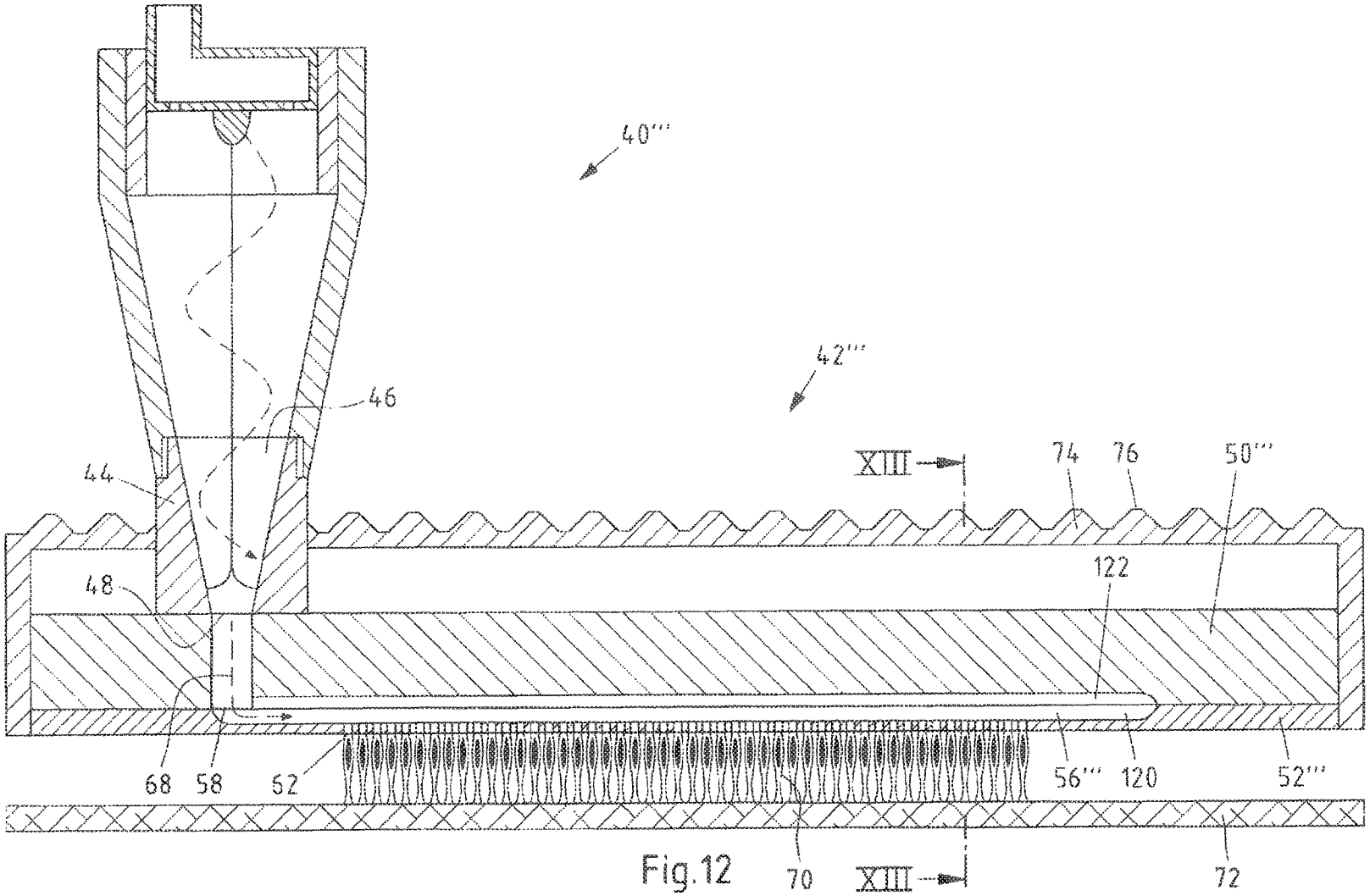
FIG. 12 shows a further exemplary embodiment of the nozzle assembly according to the invention and of the device according to the invention.

FIG. 12 shows a further exemplary embodiment of the nozzle assembly according to the invention and of the device according to the invention. The device 40'" and the nozzle assembly 42'" are substantially structurally identical to the device 40' or the nozzle assembly 42' from FIG. 4. Identical parts are respectively provided with the same reference numerals.

The nozzle assembly 42" differs from the nozzle assembly 42' in that the nozzle element 52' has a first channel-shaped recess 120 and the distributor element 50'" has a second channel-shaped recess 122, wherein the distributor member 50'" and the nozzle element 52" adjoin each other such that the first and second channel-shaped recesses 120 and 122 face each other and form the channel 56'". By this configuration, various cross-sectional shapes of the channel 56'" can be easily produced by shaping the recesses 120 and 122 accordingly. The nozzle openings 62 emanate from the first recess 120.

For example, each of the first and second channel-shaped recesses 120, 122 may have a semicircular cross section of the same radius, so that the channel 56'" has a circular cross section. The radius of the two semicircular cross sections of the first and second recesses 120, 122 may, for example, decrease continuously in the extension direction of the channel 56", so that a channel 56'" with a decreasing cross section results. Such a cross section of the channel 56'" can be much more cost-effective and easier to produce with the two recesses 120, 122 than in a channel made of solid material.

Figure 13A:
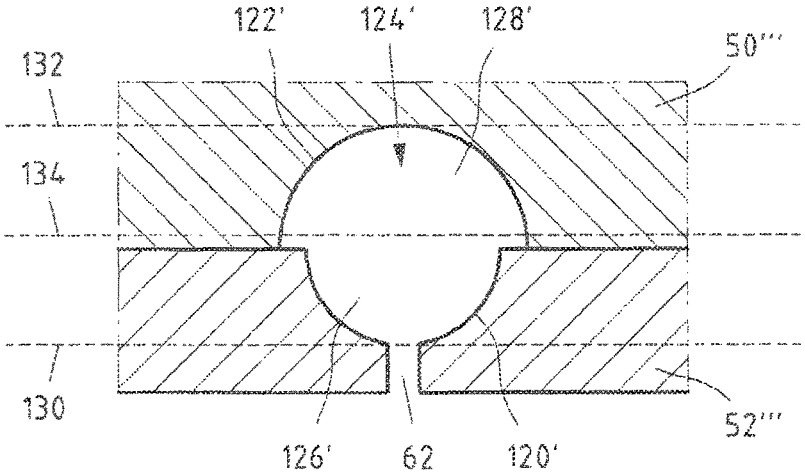
FIGS. 13*a-c* show channel cross sections of further exemplary embodiments of the nozzle assembly according to the invention.
Figure 13B:
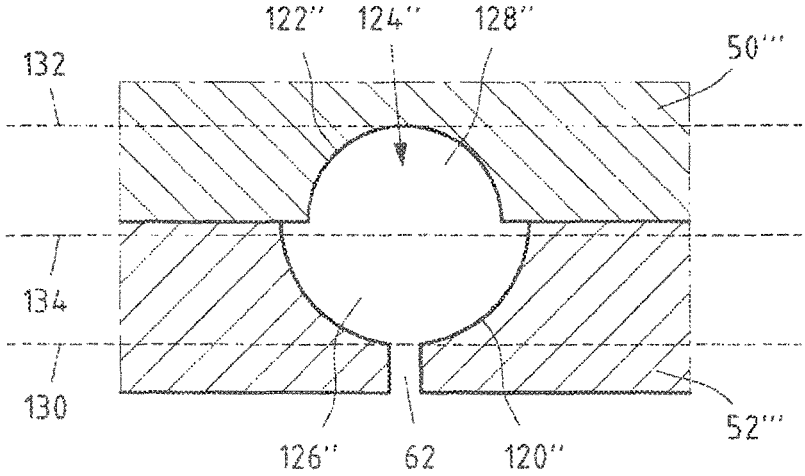
Figure 13C:
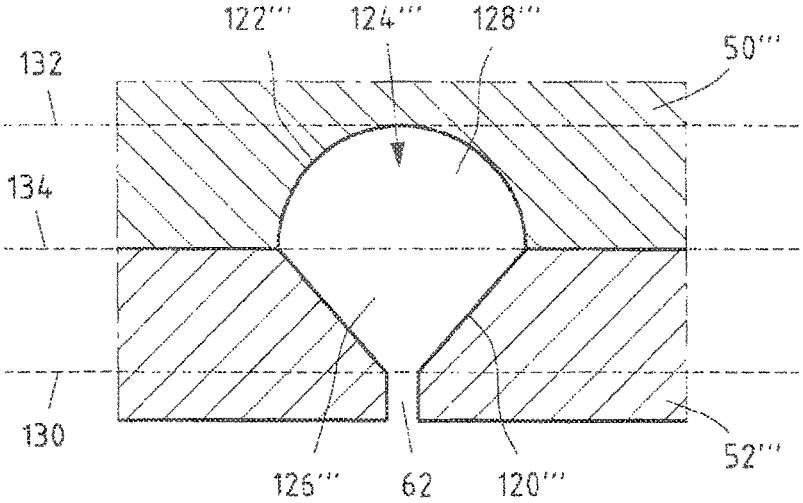

FIGS. 13*a-c* show three further possible cross sections 124', 124" and 124'" of the channel 56'" for further exemplary embodiments of the nozzle assembly according to the invention. For the sake of clarity, the figures show only the sectional plane without representing the edges located behind it. The nozzle assemblies correspond in each case to the nozzle assembly 42'" from FIG. 12, wherein the first recess and the second recess and the channel 56'" formed thereby have in each case one of the cross sections 124', 124" or 124'" illustrated in FIGS. 13*a-c*. The schematic cross-sectional representations in FIGS. 13*a-c* correspond in each case to the sectional plane designated "XIII" in FIG. 12.

FIG. 13*a* shows a first recess 120' in the nozzle element 52'" and a second recess 122' in the distributor element 50'", each having a semicircular cross section, wherein the semicircle diameter of the second recess 122' is greater than the semicircle diameter of the first recess 120'. This results in a cross section 124' of the channel of two semicircular discs opposite one another.

FIG. 13*a* further shows the virtual first tangent plane 130 of the cross section 124' through the nozzle opening 62 and the virtual second tangent plane 132 opposite thereto and running parallel thereto. The first tangent plane 132 passes through the mouth of the nozzle opening 62 into the channel and runs tangentially to the recess 124 or to the cross section 124'. Tangential here means that the first tangent plane 124 touches the channel cross section 124' but does not intersect it.

In the middle between the virtual first and second tangent plane 130 and 132, the virtual medial plane 134 is shown, which divides the cross section 124' into a first cross-sectional area 126' at the nozzle opening 62 and into a second cross-sectional area 128' opposite the nozzle opening 62. Due to the different semicircular radii of the two recesses 120' and 122', the cross-sectional surface in the second cross-sectional area 128' is greater than the cross-sectional surface in the first cross-sectional area 126'.

FIG. 13*b* likewise shows a first recess 120" in the nozzle element 52'" and a second recess 122" in the distributor element 50', each having a semicircular cross section, but in this exemplary embodiment the semicircle diameter of the first recess 120" is greater than the semicircle diameter of the second recess 122". Furthermore, the virtual first and second tangent planes 130 and 132 are also shown in FIG. 13*b*, as well as the virtual medial plane 134 which divides the cross section 124" into a first cross-sectional area 126" at the nozzle opening 62 and into a second cross-sectional area 128" opposite the nozzle opening 62. Due to the different semicircular radii of the two recesses 120" and 122", the cross-sectional surface in the second cross-sectional area 128" is smaller than the cross-sectional surface in the first cross-sectional area 128".

FIG. 13*c* shows a first recess 120'" in the nozzle element 52'" with a triangular cross section and a second recess 122'" in the distributor element 50'" with a semicircular cross section, so that the cross section 124' shown in FIG. 13*c* results. Furthermore, the virtual first and second tangent planes 130 and 123 are also shown in FIG. 13*c*, as well as and the virtual medial plane 134 which divides the cross section 124" into a first cross-sectional area 126'" at the nozzle opening 62 and into a second cross-sectional area 128" opposite the nozzle opening 62. In the cross section 124'", the cross-sectional surface of the second cross-sectional area 126'" is greater than the cross-sectional surface of the first cross-sectional area 128'".

The position of the virtual medial plane 134 is in principle independent of the contact surface between nozzle element 52'" and distributor element 50'". Thus, the medial plane 134 may coincide with the contact surface (see FIG. 13*c*), but does not have to (see FIG. 13*a-b*).

Experiments have shown that a more uniform distribution of the plasma power to the partial jets emerging from the individual nozzle openings 62 can be achieved by an asymmetrical cross section of the channel 56'", as shown for example in FIGS. 13*a-c*. Particularly good results were achieved when the cross-sectional surface of the second cross-sectional area was larger with respect to the nozzle opening 62 than the cross-sectional surface of the first cross-sectional area. Thus, the exemplary embodiments shown in FIGS. 13*a* and 13*c* are particularly preferred.

Figure 14A:
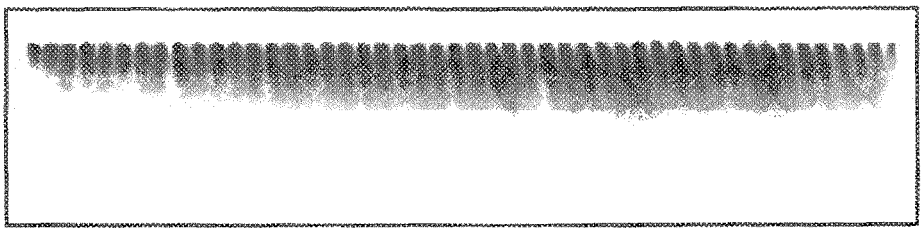
FIGS. 14*a-c* show photographs of experiments on different nozzle assemblies and FIGS. 15*a-c* show channel cross sections of the nozzle assemblies from the experiments.
Figure 14B:
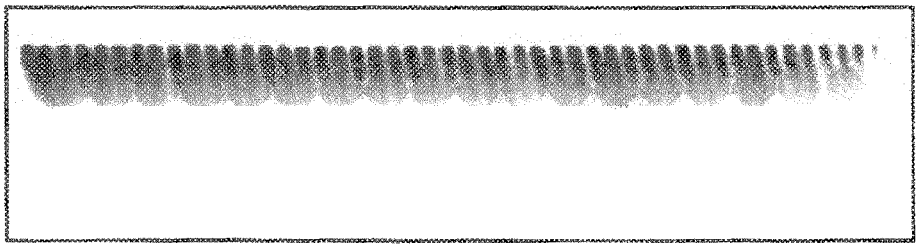
Figure 14C:
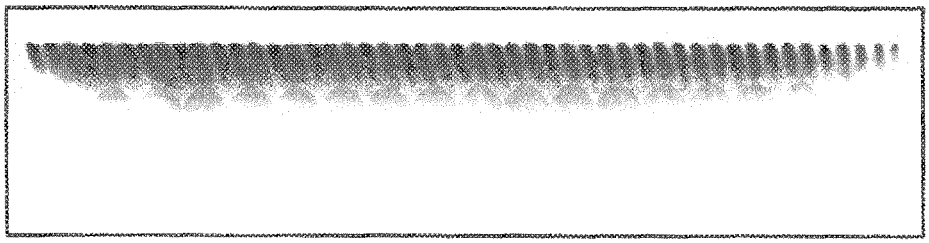
Figure 15A:
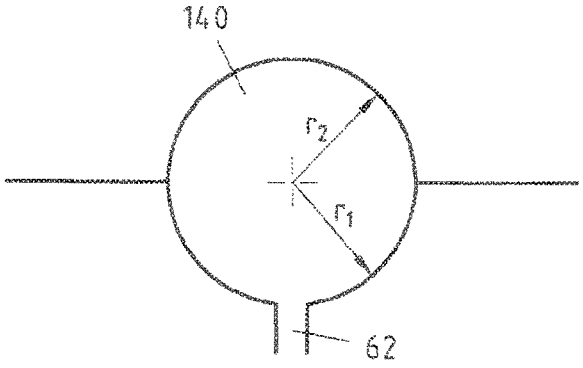
Figure 15B:
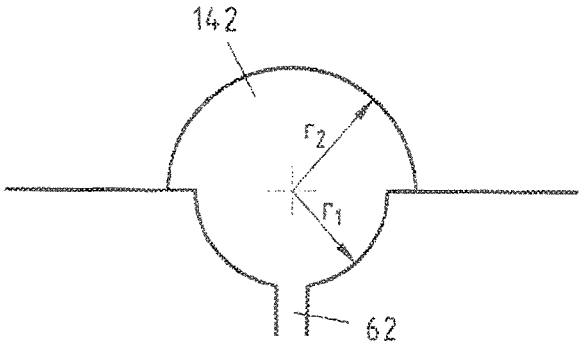
Figure 15C:
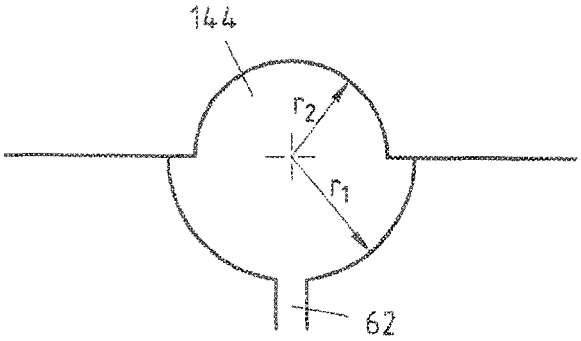

Experiments have been performed which show the advantages of an asymmetrical channel cross section. For this purpose, in each case a device was operated which corresponded to the device 40'" from FIG. 12 with different cross sections of the channel 56'". FIG. 14*a-c* show photographs of the partial jets emerging from the nozzle openings 62 of the respective nozzle assembly. FIG. 15*a-c* shows the associated channel cross sections 140, 142, 144 of the nozzle assemblies used in each case for the experiments.

The nozzle assemblies are respectively arranged at the top in FIG. 14*a-c*; the flow direction of the partial jets thus runs from top to bottom. The position of the plasma nozzle is as in FIG. 12 on the left side. For better visibility, the photographs were inverted. Thus, FIG. 14*a-c* actually show the photographic negatives, so that the actually luminous partial jets are dark, and the dark surroundings are bright.

FIG. 14*a* shows the photograph of the partial jets of a nozzle assembly with a circular channel cross section 140 corresponding to FIG. 15*a*. The first and the second recess respectively have a corresponding semicircular shape with a semicircular radius $r_1$, $r_2$ of 2 mm in each case.

FIG. 14*b* shows the photograph of the partial jets from a nozzle assembly with an asymmetrical channel cross section 142 corresponding to FIG. 15*b*. The first and second recesses each have semicircular shapes, but with a different semicircle radius, wherein $r_1$=1.5 mm and $r_2$=2.55 mm.

FIG. 14*c* shows the photograph of the partial jets from a nozzle assembly with an asymmetrical channel cross section 144 corresponding to FIG. 15*c*. The first and second recesses each have semicircular shapes, wherein $r_1$=2.55 mm and $r_2$=2 mm.

A comparison of the photographs in FIG. 14*a-c* shows that the intensity of the plasma jet in the asymmetrical channel cross sections 142 and 144 (see FIG. 14*b-c*) is better distributed to the partial jets emerging from the nozzle openings 62 than in the symmetrical channel cross section 140 (see FIG. 14*a*). This is demonstrated in particular in the lengths of the visible luminous regions of the partial jets (dark in FIGS. 14*a-c*), which is quite different in FIG. 14*a*. Thus, the visible regions of the partial jets in FIG. 14*a* are significantly shorter on the left side (i.e., near the nozzle) than on the right side.

A particularly uniform distribution of the plasma jet to the partial jets was achieved with the channel cross section 142 (see FIG. 14*b*), in which the second cross-sectional area has a larger cross-sectional surface than the first cross-sectional area.

The invention claimed is:

1. A device for generating an atmospheric plasma jet, comprising:

a discharge space, wherein the device is configured to generate the atmospheric plasma jet in the discharge space, wherein a nozzle assembly is connected to the discharge space in such a way that the atmospheric plasma jet generated in the discharge space is introduced into the nozzle assembly via an inlet of the nozzle assembly, wherein the nozzle assembly comprises a channel which is connected to the inlet of the nozzle assembly such that the atmospheric plasma jet introduced into the inlet of the nozzle assembly is conducted through the channel, wherein multiple nozzle openings are provided in a channel wall along the channel, through which the atmospheric plasma jet which is conducted through the channel can exit the nozzle assembly, wherein a reference medial plane runs in a middle of a cross-section of the channel between a reference lowermost plane of the cross-section across one nozzle opening of the multiple nozzle openings and a reference uppermost plane of the cross-section on a side of the channel opposite to the one nozzle opening, wherein the reference medial plane, the reference lowermost plane, and the reference uppermost plane are parallel to each other, and wherein the cross-section of the channel in a region of the one nozzle opening is shaped in such a way that the reference medial plane divides the cross-section into a first cross-sectional area adjacent to the one nozzle opening and a second cross-sectional area on the side of the channel opposite to the one nozzle opening, and wherein a cross-sectional surface of the first cross-sectional area differs in size or shape from a cross-sectional surface of the second cross-sectional area.

2. The nozzle assembly according to claim 1, wherein the channel has a straight section, and the multiple nozzle openings are arranged in the channel wall in an extension direction of the channel.

3. The nozzle assembly according to claim 1, wherein the channel is connected on both sides to the inlet, such that the plasma jet introduced into the nozzle assembly through the inlet is conducted into the channel from both sides.

4. The nozzle assembly according to claim 1, wherein a diameter of the multiple nozzle openings in the channel walling is at most a quarter of a diameter of the channel.

5. The nozzle assembly according to claim 1, wherein the cross section of the channel widens as a distance from the inlet increases.

6. The nozzle assembly according to claim 1, wherein the nozzle assembly is formed in several parts with a nozzle element, which comprises the channel with the multiple nozzle openings, and with a distributor element, which comprises a distribution channel through which the plasma jet introduced through the inlet is conducted to the channel on one or both sides of the channel.

7. The nozzle assembly according to claim 1, wherein the cross-sectional surface of the second cross-sectional area is greater than the cross-sectional surface of the first cross-sectional area.

8. The nozzle assembly according to claim 1, wherein the nozzle assembly is formed in several parts with a first part, in a surface of which a first recess is introduced, and with a second part in a surface of which a second recess is introduced, wherein the first part and the second part adjoin each other such that the first recess and the second recess face each other and form the channel.

9. The device according to claim 1, wherein the device is configured to generate the atmospheric plasma jet by means of an arc-like discharge in a working gas, wherein the arc-like discharge can be generated by applying a high-frequency high voltage between electrodes.

* * * * *